US009864393B2

(12) United States Patent
Horng et al.

(10) Patent No.: US 9,864,393 B2
(45) Date of Patent: Jan. 9, 2018

(54) VOLTAGE REFERENCE CIRCUIT

(71) Applicant: TAIWAN SEMICONDUCTOR MANUFACTURING COMPANY LTD., Hsinchu (TW)

(72) Inventors: Jaw-Juinn Horng, Hsinchu (TW); Amit Kundu, Hsinchu (TW)

(73) Assignee: TAIWAN SEMICONDUCTOR MANUFACTURING COMPANY LTD, Hsinchu (TW)

( * ) Notice: Subject to any disclaimer, the term of this patent is extended or adjusted under 35 U.S.C. 154(b) by 0 days.

(21) Appl. No.: 15/013,651

(22) Filed: Feb. 2, 2016

(65) Prior Publication Data

US 2016/0357212 A1 Dec. 8, 2016

Related U.S. Application Data

(60) Provisional application No. 62/171,654, filed on Jun. 5, 2015.

(51) Int. Cl.
*G05F 1/10* (2006.01)
*G05F 3/24* (2006.01)

(52) U.S. Cl.
CPC ..... *G05F 3/245* (2013.01)

(58) Field of Classification Search
CPC ..... G05F 3/245
USPC ..... 327/539–543; 323/268, 313; 307/52
See application file for complete search history.

(56) References Cited

U.S. PATENT DOCUMENTS

2004/0113682 A1* 6/2004 Hoon ..... G05F 3/262 327/543

OTHER PUBLICATIONS

Office action from the Chinese patent office for the counterpart application No. 201610194764.8 dated Jun. 22, 2017.

* cited by examiner

*Primary Examiner* — Thomas Skibinski
(74) *Attorney, Agent, or Firm* — WPAT, P.C., Intellectual Property Attorneys; Anthony King

(57) ABSTRACT

In some embodiments, a circuit includes a first transistor, a second transistor, a resistive device and an amplifier. The first transistor includes a first drain and a first gate. The second transistor includes a second drain and a second gate. The resistive device is coupled between the first gate and the second gate. The amplifier includes a first input coupled to the first drain and a second input coupled to the second drain. The amplifier is configured to keep a voltage level at the first drain and that at the second drain equal to each other.

20 Claims, 18 Drawing Sheets

VOLTAGE REFERENCE CIRCUIT

PRIORITY CLAIM AND CROSS-REFERENCE

This application claims the benefit of provisional application Ser. 62/171,654 filed on Jun. 5, 2015, entitled "VOLTAGE REFERENCE CIRCUIT" the disclosure of which is hereby incorporated by reference in its entirety

BACKGROUND

In integrated circuits, voltage reference plays an important role. Voltage reference circuits are widely used in circuits that require a fixed voltage reference to be compared to for reliability and accuracy. For example, a voltage reference circuit in theory provides a voltage irrespective of power supply variations, temperature changes and the loading on the circuit. With the development of core device design, it may be desirable to have a voltage reference circuit that is able to operate at a relatively low bias condition and becomes less susceptible to process variation.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1B:
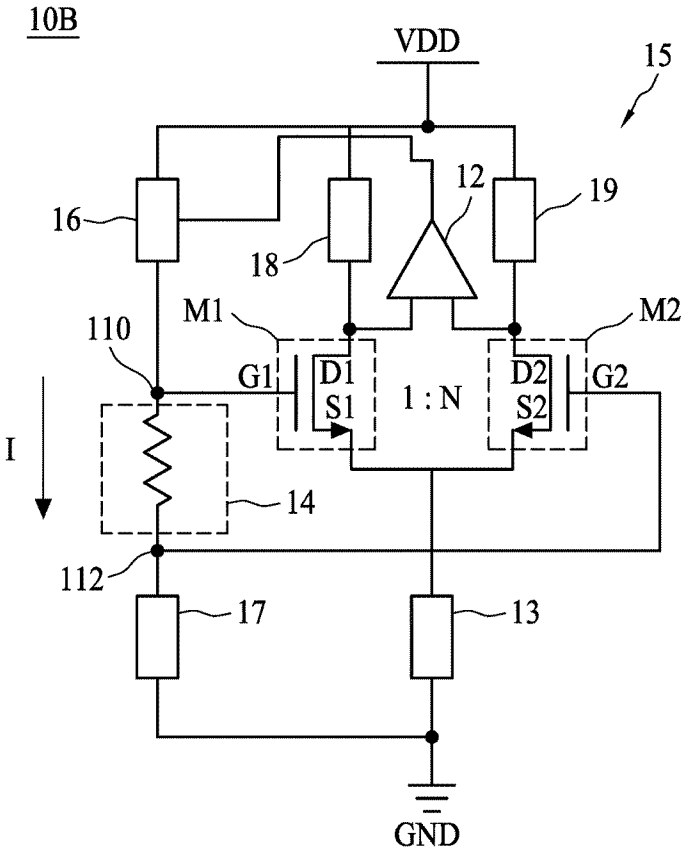
FIG. 1B is a diagram of a circuit capable of generating a current proportional to absolute temperature, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Figure 1A:
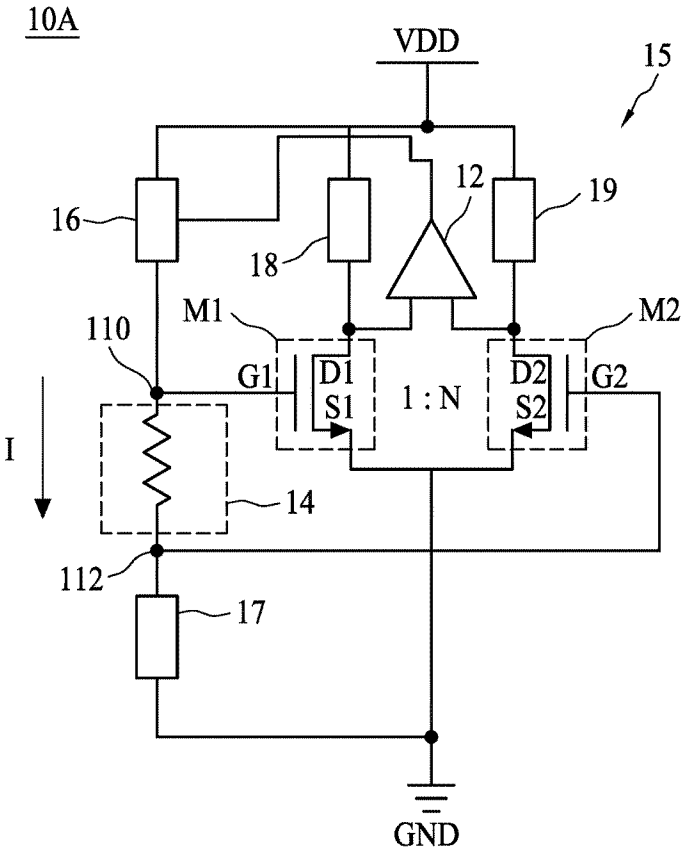
FIG. 1A is a diagram of a circuit capable of generating a current proportional to absolute temperature, in accordance with some embodiments.

FIG. 1A is a diagram of a circuit 10A capable of generating a current I proportional to absolute temperature (PTAT), in accordance with some embodiments. Referring to FIG. 1A, the circuit 10A includes a current generating circuit 15 and a resistive device 14. The current generating circuit 15 includes an amplifier 12, a first current source 18, a second current source 19, a first transistor M1 and a second transistor M2. Moreover, the circuit 10A operates in a power domain defined between a power supply VDD and a reference, for example, ground level GND. In the present embodiment, each of the first transistor M1 and the second transistor M2 includes a metal-oxide semiconductor (MOS) transistor. Further, each of the first transistor M1 and the second transistor M2 includes an n-type MOS (NMOS) transistor. In another embodiment, each of the first transistor M1 and the second transistor M2 includes a p-type MOS (PMOS) transistor. In other embodiments, each of the first transistor M1 and the second transistor M2 includes a metal-oxide-semiconductor field-effect transistor (MOSFET).

The amplifier 12 includes a first input, a second input and an output. In some embodiments, the amplifier 12 includes an operational amplifier. Furthermore, the first input is an inverting terminal of the operational amplifier, and the second input is a non-inverting terminal of the operational amplifier. Alternatively, the first input is a non-inverting terminal of the operation amplifier, and the second input is an inverting terminal of the operation amplifier. In some embodiments, the amplifier 12 provides a relatively large gain so that a voltage level at the first input of the amplifier 12 substantially equals to a voltage level at the second input of the amplifier 12.

The first transistor M1 includes a first drain D1, a first gate G1, and a first source S1. The first drain D1 is coupled to the first input of the amplifier 12, and to the power supply VDD via the first current source 18. The first gate G1 is coupled to one end 110 of the resistive device 14, and to the power supply VDD via an electrical component 16. The first source S1 is coupled to the reference GND.

In an embodiment, the electronic component 16 includes a PMOS transistor. A source of the PMOS transistor is coupled to the power supply VDD. A gate of the PMOS transistor is coupled to the output of the amplifier 12 (not illustrated in FIG. 1A). Moreover, a drain of the PMOS transistor is coupled to the resistive device 14. Accordingly, the electronic component 16 serves as a current source to provide a current, under control of the amplifier, flowing through the resistive device 14.

The resistive device 14 may be made of metal, poly or other suitable materials. In the present embodiment, the resistive device 14 includes a resistor.

The second transistor M2 includes a second drain D2, a second gate G2, and a second source S2. The second drain D2 is coupled to the second input of the amplifier 12, and to the power supply VDD via the second current source 19. The second gate G2 is coupled to the other end 112 of the resistive device 14, and to the reference GND via another electronic component 17. Moreover, the second source S2 is coupled to the reference GND, and to the first source S1 of the first transistor M1.

The first current source 18 functions to provide a current flowing through the first transistor M1, and affects the voltage level at the first drain D1 of the first transistor M1. Similarly, the second current source 19 functions to provide a current flowing through the second transistor M2, and affects the voltage level at the second drain D2 of the second transistor M2. The first current source 18 and the second current source 19 form a current mirror.

In some embodiments, the first current source 18 includes a resistor coupled or a diode connected MOS transistor (drain connected with gate) between the power supply VDD and the first drain D1. Moreover, the second current source 19 includes a resistor coupled or a diode connected MOS transistor (drain connected with gate) between the power supply VDD and the second drain D2. In some embodiments, each of the first current source 18 and the second current source 19 includes a transistor. Further, each of the first current source 18 and the second current source 19 includes a PMOS transistor. In that case, the gate of each of the PMOS transistors is coupled to the output of the amplifier 12, such that the magnitude of current provided by each of the first current source 18 and the second current source 19 is adjustable by the amplifier 12.

Since a voltage level at the first source S1 is equal to that at the second source S2, the current I can be expressed in equation (1) as follows:

$$I = \frac{VGS1 - VGS2}{R} \tag{1}$$

Where VGS1 represents a first gate to source (first gate G1 to first source S1) voltage, VGS2 represents a second gate to source (second gate G2 to second source S2) voltage, and R represents the resistance of the resistive device 14.

The first transistor M1 has a first threshold voltage Vt1, and the second transistor M2 has a second threshold voltage Vt2. In an embodiment, the first threshold voltage Vt1 is equal to the second threshold voltage Vt2. Moreover, the first transistor M1 has a first size, while the second transistor M2 has a second size. The size ratio of the first transistor M1 to the second transistor M2 is 1:N, wherein N is a positive integer greater than one. Moreover, in some embodiments, the size ratio of the first current source 18 to the second current source 19 is P:NP, wherein P is a positive integer greater than one. For example, assuming N=5 and P=20, then the size ration of the first current source 18 to the second current source 19 is 20:5*20. In some embodiments, the size ratio of the first transistor M1 to the second transistor M2 is 1:1 while the size ratio of transistors of the first current source 18 to transistors of the second current source 19 is N:1.

The first gate to source voltage VGS1 and the second gate to source voltage VGS2 can be expressed respectively in equations (2) and (3) as follows:

$$VGS1 = Vt1 * \ln\frac{ID1}{ID0} \tag{2}$$

$$VGS2 = Vt2 * \ln\frac{ID1}{ID0}\frac{1}{N} \tag{3}$$

Wherein ID0 represents a saturation current of the first transistor M1 and the second transistor M2. Since a threshold voltage (such as Vt1 and Vt2) can be expressed as Vt=k*T/q, wherein k represents Boltzmann's constant, T represents an absolute temperature, and q represents the charge of an electron. Therefore, the threshold voltage is proportional to the absolute temperature.

Then, by introducing the first gate to source voltage VGS1 shown in equation (2) and the second gate to source voltage VGS2 shown in equation (3) into equation (1), the current I can be rewritten in equation (4) as follows:

$$I = \frac{VGS1 - VGS2}{R} = \frac{Vt1\ln N}{R} \tag{4}$$

From equation (4), the current I is determined by the voltage difference between the first gate to source voltage VGS1 and second gate to source voltage VGS2. Furthermore, since the first threshold voltage Vt1 (or the second threshold voltage Vt2) is proportion to absolute temperature (PTAT), the current I is a PTAT current.

In some embodiments, the size ratio of the first transistor M1 to the second transistor M2 is still 1:N, and the first threshold voltage Vt1 is different from the second threshold voltage Vt2. The current I flowing through the resistive device 14 is still a PTAT current.

Referring back to FIG. 1A, since the first drain D1 of the first transistor M1 and the second drain D2 of the second transistor M2 are respectively coupled to the first input and the second input of the amplifier 12, by function of the amplifier 12, the voltage level at the first drain D1 and the voltage level at the second drain D2 are kept equal to each other. With the amplifier 12, variation in the current I resulting from the voltage difference between the first drain D1 and the second drain D2, if any, is alleviated or even eliminated. In the absence of the amplifier 12, the first gate to source voltage VGS1 or the second gate to source voltage VGS2 varies as the current I varies. Consequently, the current flowing through the first transistor M1 or the current flowing through the second transistor M2 varies. In that case, the voltage level at the first drain D1 or the voltage level at the second drain D2 varies. Since the voltage level at the first drain D1 and the voltage level at the second drain D2 are not equal to each other, variation in the current I is not cured.

In some existing approaches using two NMOS transistors, a PTAT current flowing through a resistor is determined by the voltage difference between two gate-to-source voltages (VGSs). However, voltage levels at the drains of the two NMOS transistors are not kept equal. The voltage difference between the drains may incur current variation in the PTAT current.

FIG. 1B is a diagram of a circuit 10B capable of generating a current I proportional to absolute temperature, in accordance with some embodiments. The circuit 10B is similar to the circuit 10A except that, for example, the circuit 10B further includes a tail current source 13. Referring to FIG. 1B, the tail current source 13 is coupled between the first source S1 of the first transistor M1 (or the second source S2 of the second transistor M2) and the reference GND. The tail current 13 functions to provide current to the first transistor M1 and the second transistor M2.

Figure 1D:
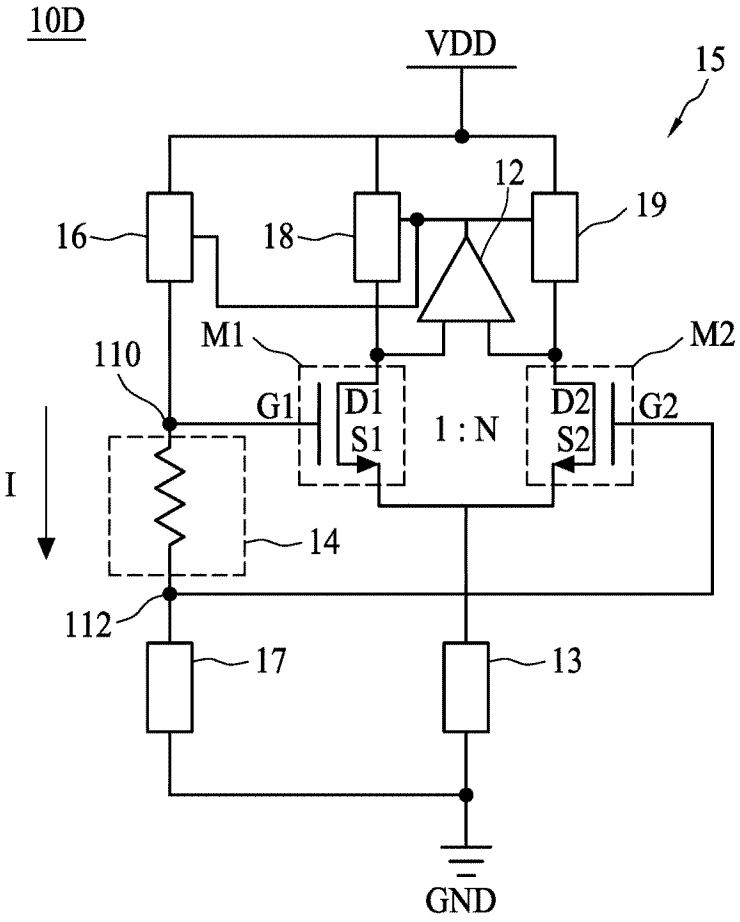
FIG. 1D is a diagram of a circuit capable of generating a current proportional to absolute temperature, in accordance with some embodiments.
Figure 1C:
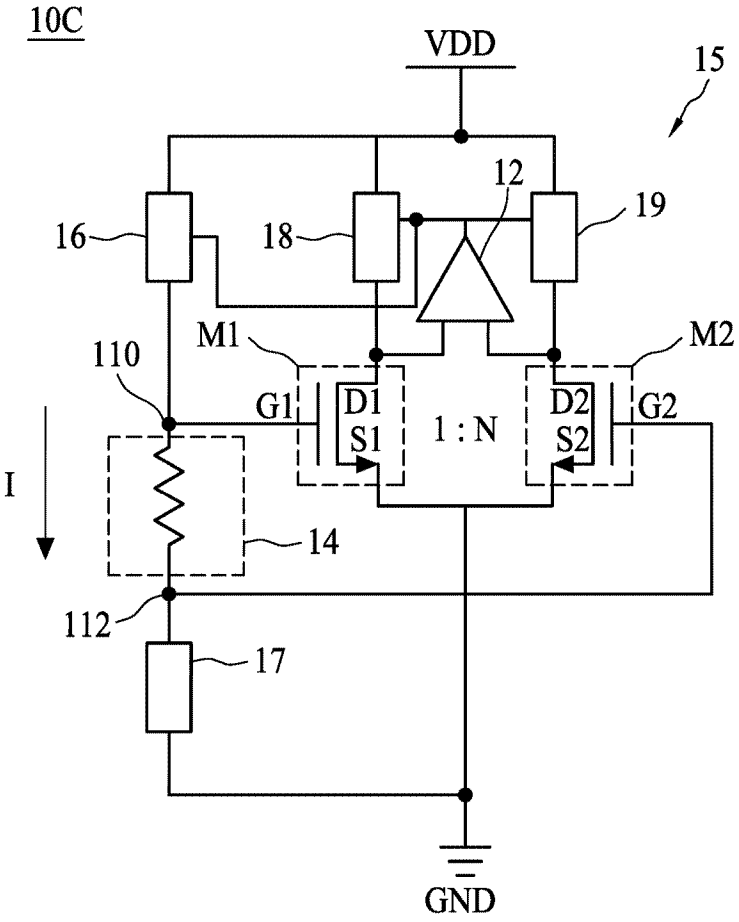
FIG. 1C is a diagram of a circuit capable of generating a current proportional to absolute temperature, in accordance with some embodiments.

FIG. 1C is a diagram of a circuit 10C capable of generating a current I proportional to absolute temperature, in accordance with some embodiments. Referring to FIG. 1C, the circuit 10C is similar to the circuit 10A described and illustrated with reference to FIG. 1A except that, for example, electrical connection between the amplifier 12, first current source 18 and second current source 19 illustrated in FIG. 1C is different from that illustrated in FIG. 1A. Specifically, an output of the amplifier 12 is coupled to the electrical component 16A, the first current source 18 and the second current source 19, and functions to control the electrical component 16A, the first current source 18 and the second current source 19.

FIG. 1D is a diagram of a circuit 10D capable of generating a current I proportional to absolute temperature, in accordance with some embodiments. Referring to FIG. 1D, the circuit 10D is similar to the circuit 10C illustrated and described with reference to FIG. 1C except that, the circuit 10D further includes a tail current source 13. Referring to FIG. 1D, the tail current source 13 is coupled between the first source S1 of the first transistor M1 (or the second source S2 of the second transistor M2) and the reference GND. The tail current I3 functions to provide current to the first transistor M1 and the second transistor M2.

Figure 2:
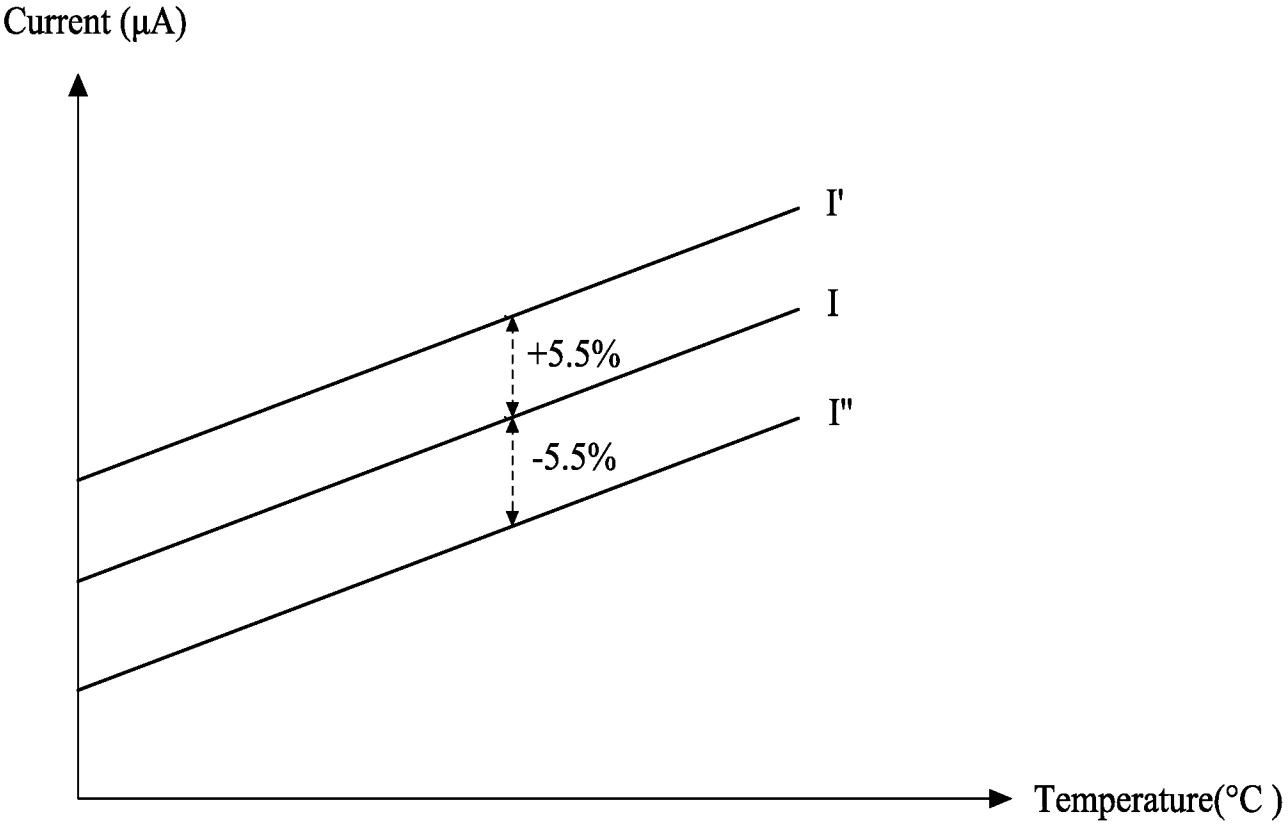
FIG. 2 is a schematic diagram showing simulation results of the circuit illustrated in FIG. 1A.

FIG. 2 is a schematic diagram showing simulation results of the circuit 10A illustrated in FIG. 1A. Referring to FIG. 2, the horizontal axis represents temperature in Celsius degree (° C.), and the vertical axis represents magnitude of the current I in microampere (μA). In the simulation, a large number such as hundreds of integrated chips including the circuit 10A may be employed. Moreover, the PTAT current of each integrated chip is measured and recorded. Accordingly, hundreds of such PTAT currents at various temperatures can be obtained. In some embodiments, temperature ranges from −40° C. to 125° C. For illustration, only three currents I, I' and I" among those PTAT currents are shown in FIG. 2, wherein I' and I" represent an upper boundary and a lower boundary, respectively. Also for illustration, the spacing (i.e., variation) between currents I and I" and between currents I and I' is exaggerated. Ideally, the variation is substantially zero so that curves representing the currents I, I' and I" completely overlap with one another. The simulation results reveal that current variation is approximately ±5.5%, which is relatively low and desirable. In other words, the accuracy is relatively high. As a result, when a large number of integrated chips including the circuit 10A are fabricated, currents provided by the circuits 10 in the integrated chips are close to each other.

Figure 3:
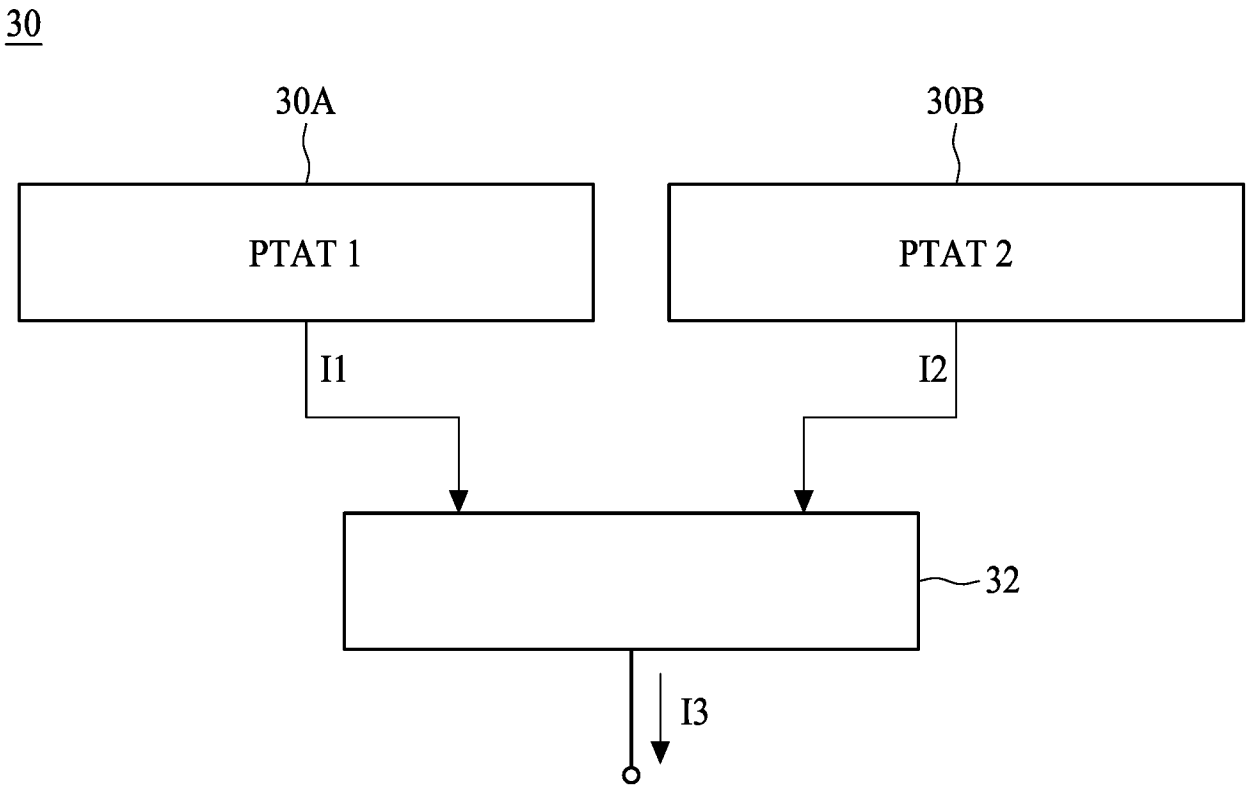
FIG. 3 is a block diagram of a circuit capable of generating a current irrespective of temperature variation, in accordance with some embodiments.

FIG. 3 is a block diagram of device circuit 30 capable of generating a current I3 irrespective of temperature variation, in accordance with some embodiments. Referring to FIG. 3, the circuit 30 includes a first proportional to absolute temperature (PTAT) current generation device 30A, a second PTAT current generation device 30B and a current subtracter 32.

The first PTAT current generation device 30A, coupled to the current subtracter 32, is configured to generate a first PTAT current I1. In an embodiment, the first PTAT current generation device 30A is similar to the circuit 10A described and illustrated with reference to FIG. 1A except that, for example, the electronic component 17 thereof is coupled to the current subtracter 32 rather than the reference GND.

The second PTAT current generation device 30B, coupled to the current subtracter 32, is configured to generate a second PTAT current I2. In an embodiment, the second PTAT current generation device 30B is similar to the circuit 10A described and illustrated with reference to FIG. 1A except that, for example, the electronic component 17 thereof is coupled to the current subtracter 32 rather than the reference GND.

The current subtracter 32 receives the first PTAT current I1 and the second PTAT current I2, and produces the current I3 irrespective of temperature variation by either subtracting the second PTAT current I2 from the first PTAT current I1, or subtracting the first PTAT current I1 from the second PTAT current I2, thereby countercanceling the temperature-dependent factor in the PTAT currents I1 and I2.

In the first PTAT current generation device 30A, the first PATA current I1 is determined by a first gate to source voltage VGS1 and a second gate to source voltage VGS2. Moreover, the first transistor M1 has a first threshold voltage Vt1 and the second transistor M2 has a second threshold voltage Vt2 different from the first threshold voltage Vt1. As a result, the current I3 is determined by the difference between the first threshold voltage Vt1 and the second threshold voltage Vt2, which will be described in detail with reference to FIG. 4A. The current I3 is a substantially constant current and is irrespective of temperature variation. Moreover, since the current I3 is determined by the difference between the threshold voltages Vt1 and Vt2 and further since the threshold voltages can be well controlled by process, magnitude of the current I3 can also be well controlled and predetermined, which facilitates the circuit design.

To obtain a current irrespective of temperature variation, in some existing approaches, a complementary to absolute temperature (CTAT) current is added to a PTAT current. However, the CTAT current is liable to variation. As a result, even though a constant current might be obtained by adding the PTAT current to the CTAT current, magnitude of the constant current cannot be well controlled and thus may be difficult to predetermine.

Figure 4A:
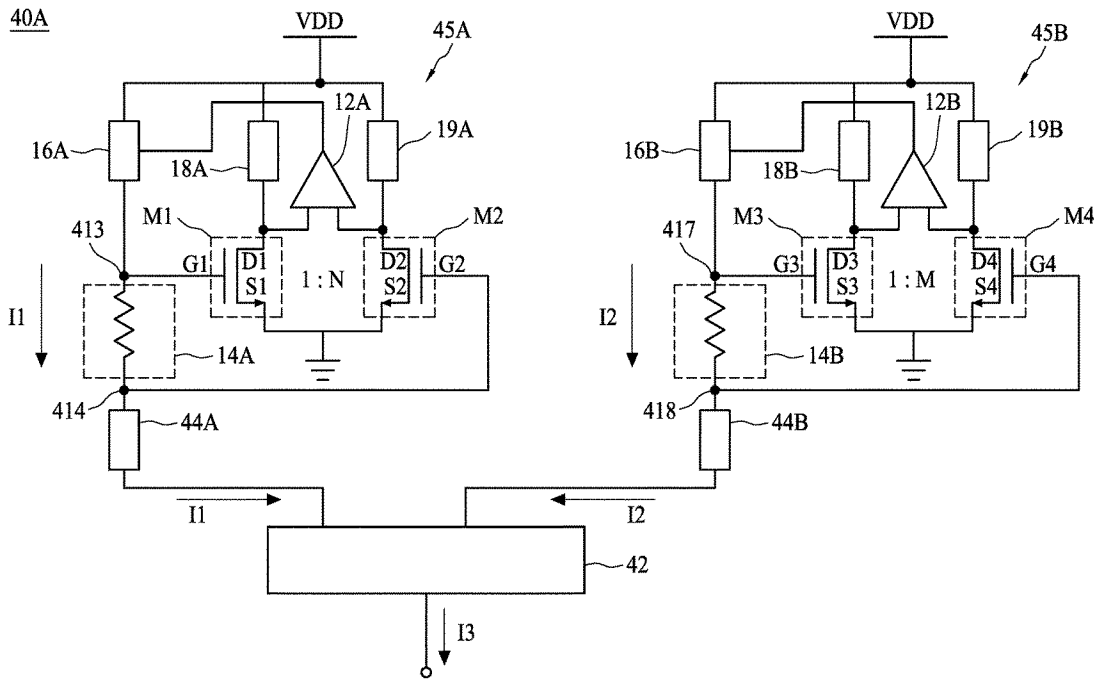
FIG. 4A is a diagram of a circuit capable of generating a current irrespective of temperature variation, in accordance with some embodiments.

FIG. 4A is circuit diagram of a circuit 40A capable of generating a current I3 irrespective of temperature variation, in accordance with some embodiments. Referring to FIG.

4A, the circuit 40A includes a first PTAT current generating circuit 45A, a second PTAT current generating circuit 45B, a resistive device 14A, a resistive device 14B and a current subtracter 42.

The first PTAT current generating circuit 45A, similar in structure to the circuit 10A described and illustrated with reference to FIG. 1A, includes an amplifier 12A, a first current source 18A, a second current source 19A, a first transistor M1 and a second transistor M2.

The first transistor M1 includes a first drain D1, a first gate G1, and a first source S1. The first drain D1 is coupled to the first input of the amplifier 12A, and to the power supply VDD via the first current source 18A. The first gate G1 is coupled to one end 413 of the resistive device 14A, and to the power supply VDD via an electrical component 16A. The first source S1 is coupled to the reference GND.

The second transistor M2 includes a second drain D2, a second gate G2, and a second source S2. The second drain D2 is coupled to the second input of the amplifier 12A, and to the power supply VDD via the second current source 19A. The second gate G2 is coupled to the other end 414 of the resistive device 14A, and to the current subtracter 42 via an electronic component 44A. Moreover, the second source S2 is coupled to the reference GND, and to the first source S1 of the first transistor M1.

The first PTAT current I1 can be expressed in equation (5) as follows:

$$I1 = \frac{VGS1 - VGS2}{R1} \tag{5}$$

Where VGS1 represents a first gate to source (first gate G1 to first source S1) voltage, VGS2 also represents a second gate to source (second gate G2 to second source S2) voltage and R1 represents the resistance of the resistive device 14A. The first PTAT current I1 flows through the resistance device 14A, and is determined by a first voltage difference between the first gate to source voltage VGS1 and the second gate to source voltage VGS2.

The second PTAT current generating circuit 45B, similar in structure to the circuit 10A described and illustrated with reference to FIG. 1A, includes an amplifier 12B, a third current source 18B, a fourth current source 19B, a third transistor M3 and a fourth transistor M4.

The third transistor M3 includes a third drain D3, a third gate G3, and a third source S3. The third drain D3 is coupled to the first input of the amplifier 12B, and to the power supply VDD via the third current source 18B. The third gate G3 is coupled to one end 417 of the resistive device 14B, and to the power supply VDD via an electronic component 16B. The third source S3 is coupled to the reference GND.

The fourth transistor M4 includes a fourth drain D4, a fourth gate G4, and a fourth source S4. The fourth drain D4 is coupled to the second input of the amplifier 12B, and to the power supply VDD via the fourth current source 19B. The fourth gate G4 is coupled to the other end 418 of the resistive device 14B, and to the current subtracter 42 via an electronic component 44B. Moreover, the fourth source S4 is coupled to the reference GND, and to the third source S3 of the third transistor M3.

The second PTAT current I2 is expressed in equation (6) as follows:

$$I2 = \frac{VGS3 - VGS4}{R2} \tag{6}$$

Where VGS3 represents a third gate to source (third gate G3 to first third S3) voltage, VGS4 also represents a fourth gate to source (fourth gate G4 to fourth source S4) voltage and R2 represents the resistance of the resistive device 14B. The second PTAT current I2 flows through the resistance device 14B, and is determined by a second voltage difference between a first gate to source voltage VGS3 and the fourth gate to source voltage VGS4.

The current subtracter 42 receives the first PTAT current I1 and the second PTAT current I2, and produces the current I3 irrespective of temperature variation by either subtracting the first PTAT current I1 from the second PTAT current I2, or subtracting the second PTAT current I2 from the first PTAT current I1, thereby countercanceling the temperature-dependent factor in the first PTAT current I1 and the second PTAT current I2. In the present embodiment, the current I3 is generated by subtracting the second PTAT current I2 from the first PTAT current I1. The current I3 can be expressed in equation (7) as follows:

$$I3 = I1 - I2 = \frac{(VGS1 - VGS2)}{R1} - \frac{(VGS3 - VGS4)}{R2} \tag{7}$$

From equation (7), the current I3 irrespective of temperature variation is determined by a voltage difference between the first voltage difference (VGS1−VGS2) and the second voltage difference (VGS3−VGS4).

The first transistor M1 has a first threshold voltage Vt1, and the second transistor M2 has a second threshold voltage Vt2. In an embodiment, the first threshold voltage Vt1 is equal to the second threshold voltage Vt2. Moreover, the first transistor M1 has a first size, while the second transistor M2 has a second size. A first size ratio of the first transistor M1 to the second transistor M2 is 1:N. The first voltage difference (VGS1−VGS2) can be further expressed in equation (8) as follows:

$$\begin{aligned} VGS1 - VGS2 &= Vt1\ln\frac{ID}{I0} - Vt2\ln\frac{ID}{I0}\frac{1}{N} \\ &= (Vt2 + \Delta Vt')\ln\frac{ID}{I0} - (Vt2)\ln\frac{ID}{I0}\frac{1}{N} \\ &= Vt2\ln N + \Delta Vt'\ln\frac{ID}{I0} \\ &\approx Vt2\ln N + \Delta Vt' \end{aligned} \tag{8}$$

Where ID represents a current flowing through the first transistor M1 and the second transistor M2, I0 represents a saturation current associated with the first transistor M1 and the second transistor M2, and ΔVt' represents a difference between the first threshold voltage Vt1 and the second threshold voltage Vt2.

The above equation (8) can be simplified by, for example, replacing the term "Vt1" with the term "Vt2+ΔVt'" or by replacing the term "Vt2" with the term "Vt1+ΔVt'". In this way, the first voltage difference (VGS1−VGS2) can be expressed as (Vt1 ln N+ΔVt'). In the case that the first threshold voltage Vt1 is equal to the second threshold voltage Vt2, the first voltage difference (VGS1−VGS2) can be expressed as (Vt1 ln N).

Likewise, the third transistor M3 has a third threshold voltage Vt3, and the fourth transistor M4 has a fourth threshold voltage Vt4. In an embodiment, the third threshold voltage Vt3 is equal to the fourth threshold voltage Vt4.

Moreover, the third transistor M3 has a third size, while the fourth transistor M4 has a fourth size. A second size ratio of the third transistor M3 to the fourth transistor M4 is 1:M. Therefore, the second voltage difference (VGS3−VGS4) can be expressed as (Vt3 ln M+ΔVt") or (Vt4 ln M+ΔVt"), wherein ΔVt" represents a difference between the third threshold voltage Vt3 and the fourth threshold voltage Vt4. In an embodiment, the third threshold voltage Vt3 is equal to the fourth threshold voltage Vt4, and therefore the second voltage difference (VGS3−VGS4) can be expressed as (Vt3 ln M) or (Vt4 ln M).

Based on the above equations, the current I3 in equation (7) can be rewritten in equation (9) as follows:

$$\begin{aligned} I3 = I1 - I2 &= \frac{(VGS1 - VGS2)}{R1} - \frac{(VGS3 - VGS4)}{R2} \\ &= \frac{Vt2\ln N + \Delta Vt'}{R1} - \frac{Vt4\ln M + \Delta Vt''}{R2} \\ &= \left(\frac{Vt2\ln N}{R1} - \frac{Vt4\ln M}{R2}\right) + \left(\frac{\Delta Vt'}{R1} - \frac{\Delta Vt''}{R2}\right) \\ &\approx \left(\frac{Vt2\ln N}{R1} - \frac{Vt4\ln M}{R2}\right) + (\Delta Vt' - \Delta Vt'') \end{aligned} \tag{9}$$

Alternatively, the current I3 can be rewritten in equation (10) below.

$$I3 = \left(\frac{Vt1\ln N}{R1} - \frac{Vt3\ln M}{R2}\right) + (\Delta Vt' - \Delta Vt'') \tag{10}$$

In view of equations (9) and (10), it can be found that the current I3 is a function of the first size ratio, the second size ratio, the resistance of the resistive device 14A and the resistance of the resistive device 14B. To make the current I3 irrespective of temperature variation or a substantially constant current, the circuit 40A can be designed in accordance with equation (11) as follows:

$$\frac{Vtx\ln N}{R1} = \frac{Vtz\ln M}{R2} \tag{11}$$

Where Vtx represents one of the first threshold voltage Vt1 and the second threshold voltage Vt2, and Vtz represents one of the third threshold voltage Vt3 and the fourth threshold voltage Vt4 corresponding to Vt1 and Vt2, respectively.

In some embodiments, at least one of the first threshold voltage Vt1, the second threshold voltage Vt2, the third threshold voltage Vt3 and the fourth threshold voltage Vt4 is different from the remaining.

In some embodiments, the circuit 40A is designed with the first size ratio equal to the second size ratio, the resistance of the resistive device 14A equal to the resistance of the resistive device 14B, the second threshold voltage Vt2 equal to the fourth threshold voltage Vt4 and different from the first threshold voltage Vt1, and the fourth threshold voltage Vt4 different from the third threshold voltage Vt3. Then, the current I3 can be expressed in equation (12) as follows:

$$I3 = (\Delta Vt' - \Delta Vt'') \tag{12}$$

Accordingly, the current I3 is a constant current determined by a difference between threshold voltages, and is irrespective of temperature variation. Moreover, the current I3 can be well controlled by process.

Slope of the currents I1 and I2 (referring to FIG. 5) may be adjusted by adjusting the resistance of the resistive device 14A and the resistive device 14B. Accordingly, if the current I1 and the current I2 have substantially the same slope within a temperature range, the resistance of the resistive device 14A is equal to the resistance of resistive device 14B. In some embodiments, the circuit 40A is designed with the resistance of the resistive device 14A equal to the resistance of resistive device 14B, the first size ratio equal to the second size ratio, the first threshold voltage Vt1 different from the second threshold voltage Vt2 and equal to the third threshold voltage Vt3, and the third threshold voltage Vt3 equal to the fourth threshold voltage Vt4. Then, the current I3 can be expressed as (ΔVt'). Therefore, the current I3 is a constant current, which can be determined by a difference between threshold voltages. The current I3 is irrespective of temperature variation and can be well controlled by process.

Moreover, as previously discussed in the embodiments illustrated in FIG. 1A, since a first drain D1 of a first transistor M1 and a second drain D2 of a second transistor M2 are respectively coupled to a first input and a second input of the amplifier 12A, the voltage level at the first drain D1 and the voltage level at the second drain D2 are kept equal to each other by the amplifier 12A. With the amplifier 12A, variation in the current I1 resulting from the voltage difference between the first drain D1 and the second drain D2, if any, is alleviated or even eliminated.

Similarly, since a third drain D3 of a third transistor M3 and a fourth drain D4 of a fourth transistor M4 are respectively coupled to a first input and a second input of the amplifier 12B, the voltage level at the third drain D3 and the voltage level at the fourth drain D4 are kept equal by the amplifier 12B. With the amplifier 12B, variation in the current I2 resulting from the voltage difference between the third drain D3 and the fourth drain D4, if any, is alleviated or even eliminated.

Since variation in the current I1 and the current I2 is alleviated or even eliminated, variation in the current I3 is therefore alleviated or even eliminated.

Figure 4B:
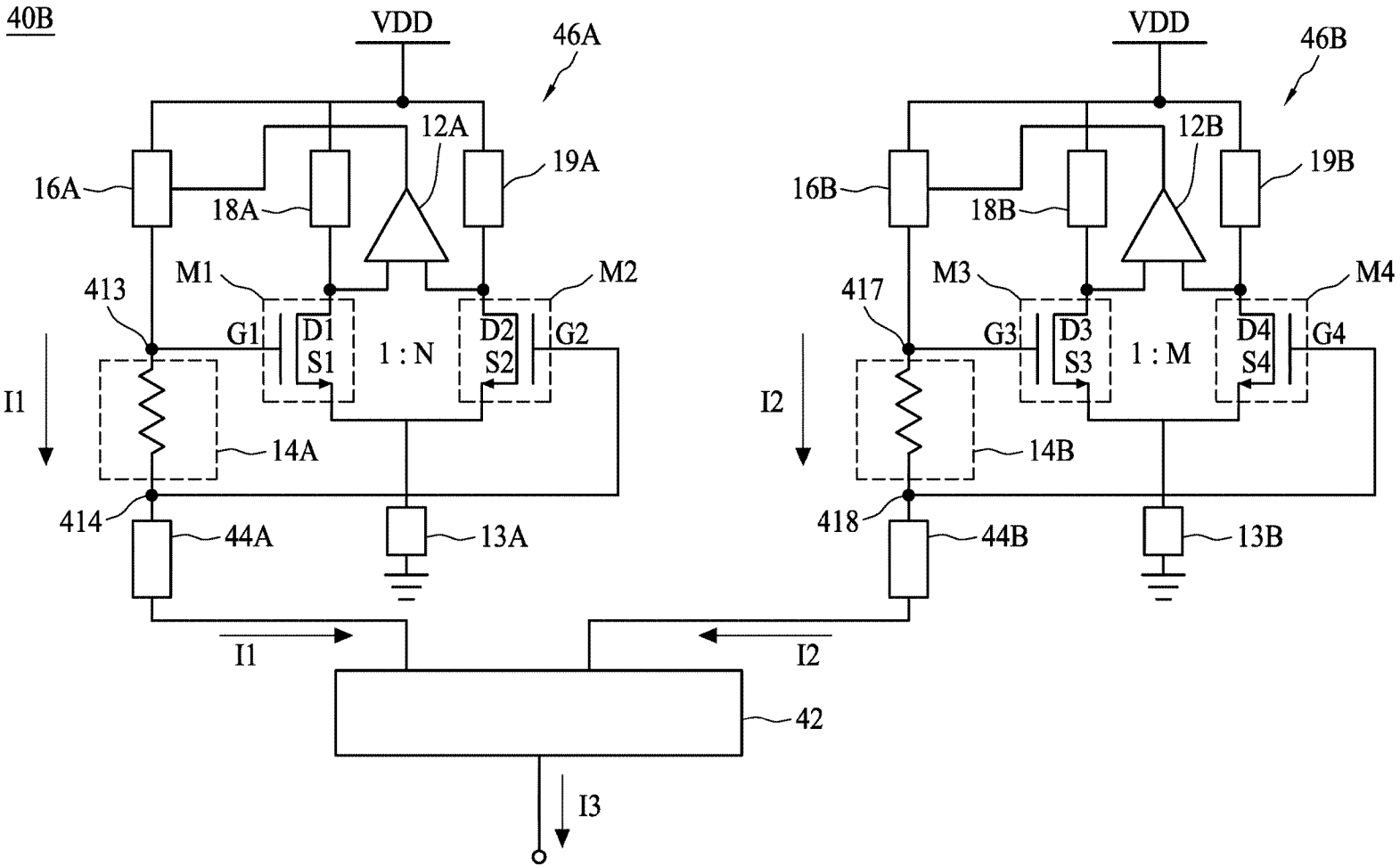
FIG. 4B is a diagram of a circuit capable of generating a current irrespective of temperature variation, in accordance with some embodiments.

FIG. 4B is a diagram of a circuit 40B capable of generating a current I3 irrespective of temperature variation, in accordance with some embodiments. Referring to FIG. 4B, the circuit 40B is similar to the circuit 40A described and illustrated with reference to FIG. 4A except that, for example, the circuit 40B includes a first PTAT generating circuit 46A including a first tail current source 13A and a second PTAT generating circuit 46B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 4C:
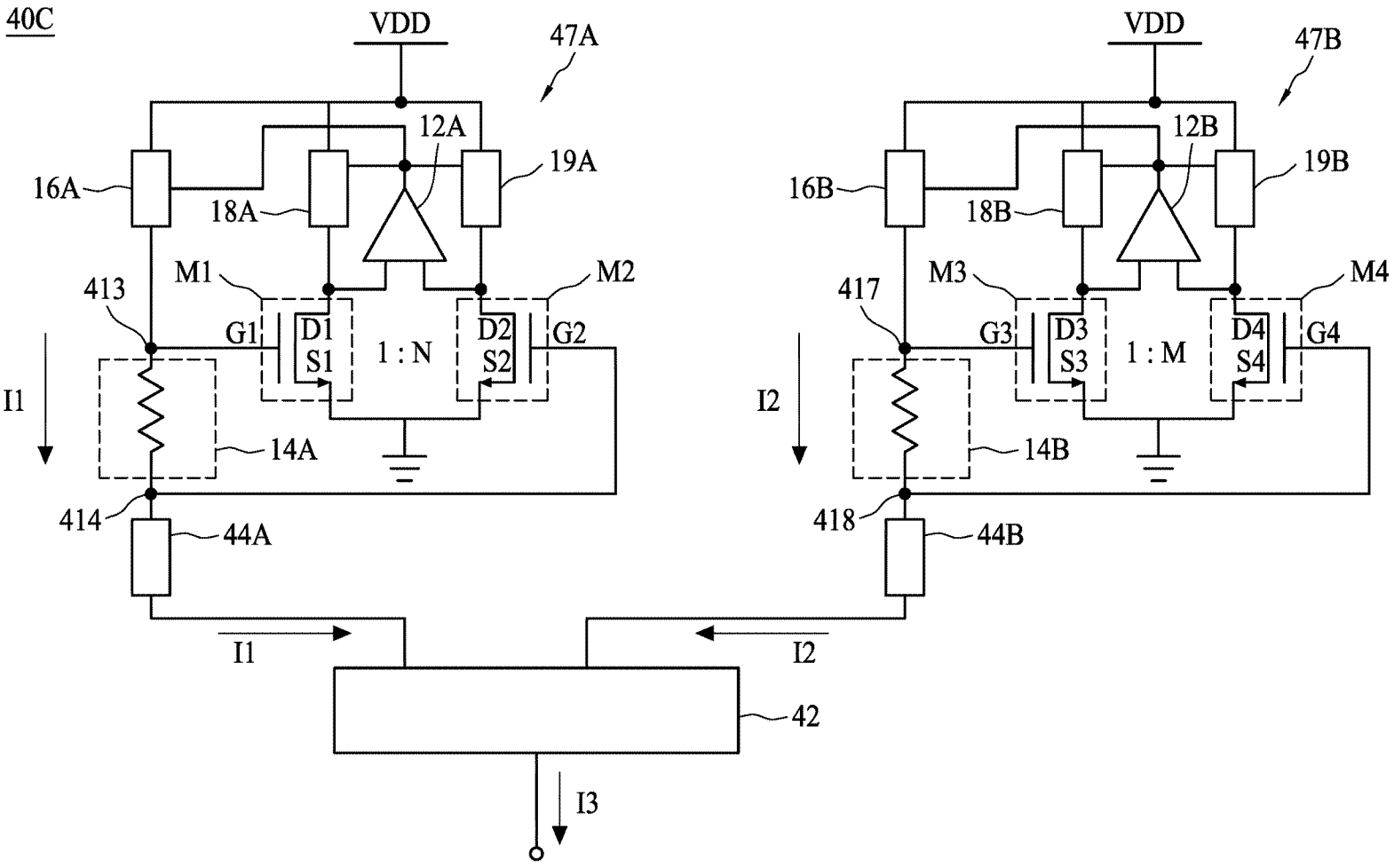
FIG. 4C is a diagram of a circuit capable of generating a current irrespective of temperature variation, in accordance with some embodiments.

FIG. 4C is a diagram of a circuit 40C capable of generating a current I3 irrespective of temperature variation, in accordance with some embodiments. Referring to FIG. 4C, the circuit 40C is similar to the circuit 40A described and illustrated with reference to FIG. 4A except that electrical connection between the amplifier 12A, first current source 18A and second current source 19A of the first PTAT generating circuit 47A and between the amplifier 12B, third current source 18B and fourth current source 19B of the second PTAT generating circuit 47B is different from that between similar components of the first PTAT generating circuit 45A and the second PTAT generating circuit 45B described and illustrated with reference to FIG. 4A. Specifically, an output of the amplifier 12A is coupled to the electrical component 16A, the first current source 18A and the second current source 19A, and functions to control the electrical component 16A, the first current source 18A and the second current source 19A. Similarly, an output of the amplifier 12B is coupled to the electrical component 16B, the first current source 18A and the second current source 19A, and functions to control the electrical component 16B, the first current source 18B and the second current source 19B.

Figure 4D:
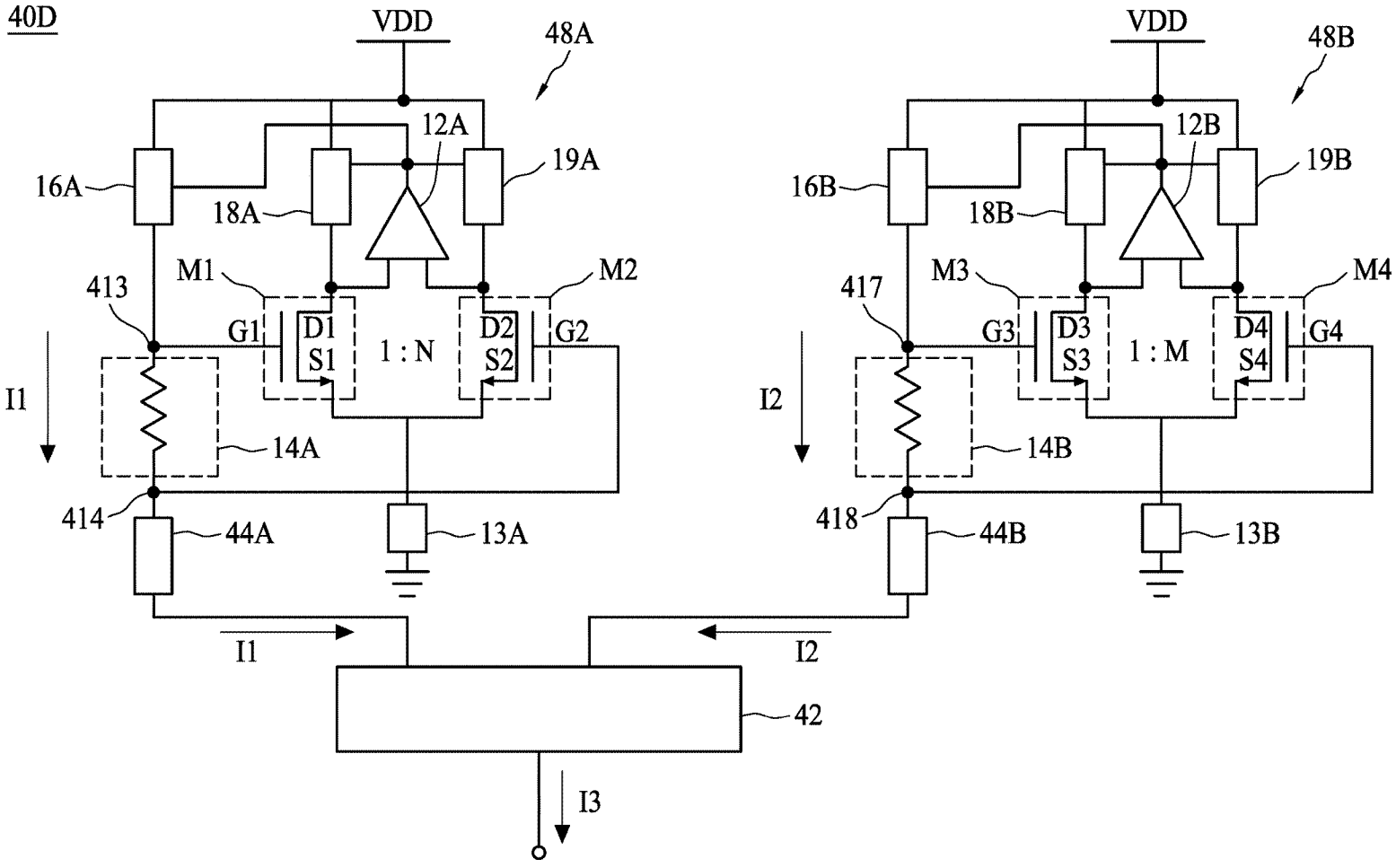
FIG. 4D is a diagram of a circuit capable of generating a current irrespective of temperature variation, in accordance with some embodiments.

FIG. 4D is a diagram of a circuit 40D capable of generating a current I3 irrespective of temperature variation, in accordance with some embodiments. Referring to FIG. 4D, the circuit 40D is similar to the circuit 40C described and illustrated with reference to FIG. 4C except that, for example, the circuit 40C includes a first PTAT generating circuit 48A including a first tail current source 13A and a second PTAT generating circuit 48B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 4E:
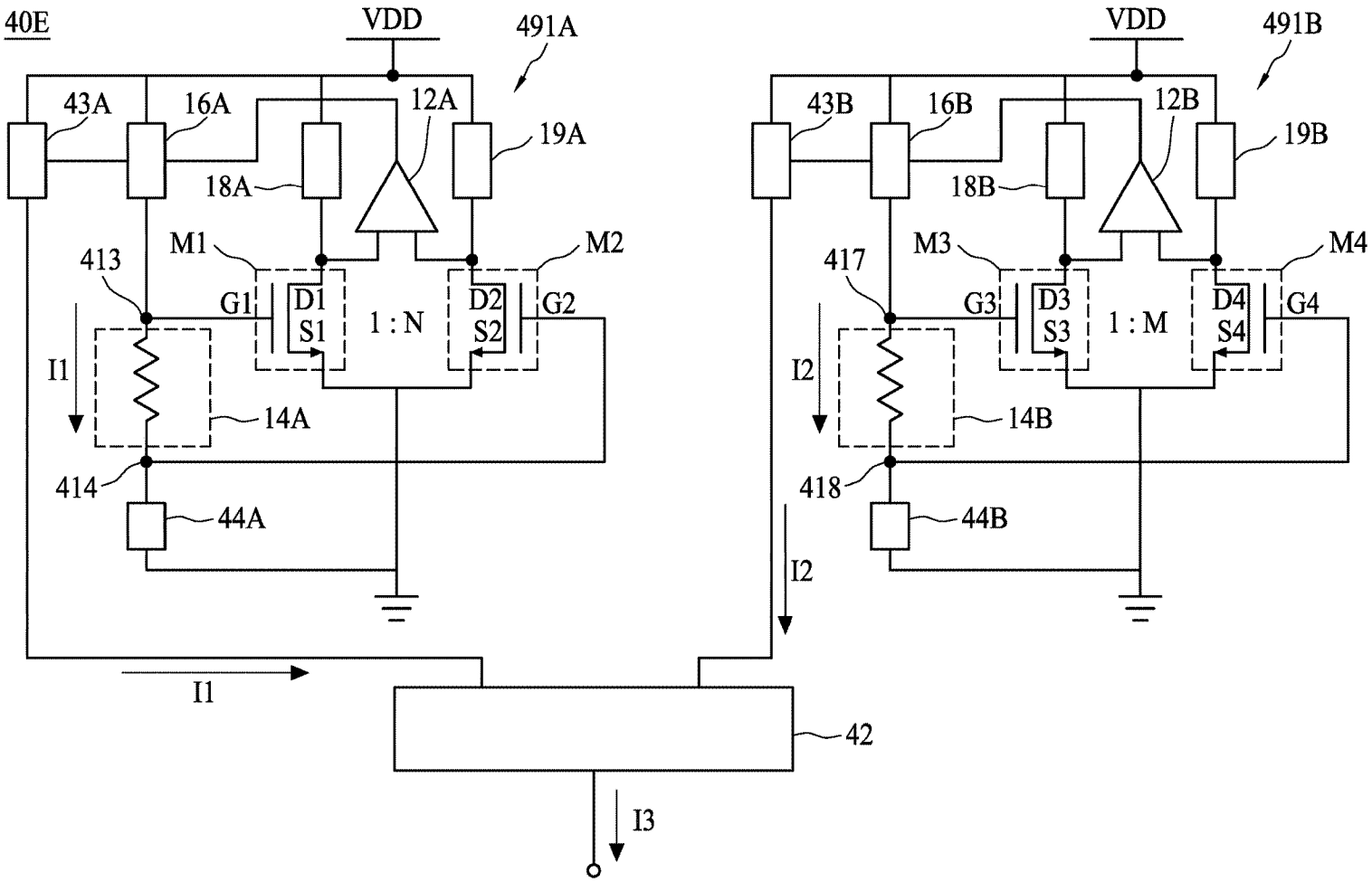
FIG. 4E is a diagram of a circuit capable of generating a current irrespective of temperature variation, in accordance with some embodiments.

FIG. 4E is a diagram of a circuit 40E capable of generating a current I3 irrespective of temperature variation, in accordance with some embodiments. Referring to FIG. 4E, the circuit 40E is similar to the circuit 40A described and illustrated with reference to FIG. 4A except that, for example, the circuit 40E includes a first PTAT generating circuit 491A including a current source 43A and a second PTAT generating circuit 491B including a current source 43B. The current source 43A and an electronic component 16A forms a current mirror, and therefore a current flowing through the current source 43A is the same as that flowing through the electronic component 16A. Similarly, the current source 43B and an electronic component 16B forms a current mirror, and therefore a current flowing through the current source 43B is the same as that flowing through the electronic component 16B.

Figure 4F:
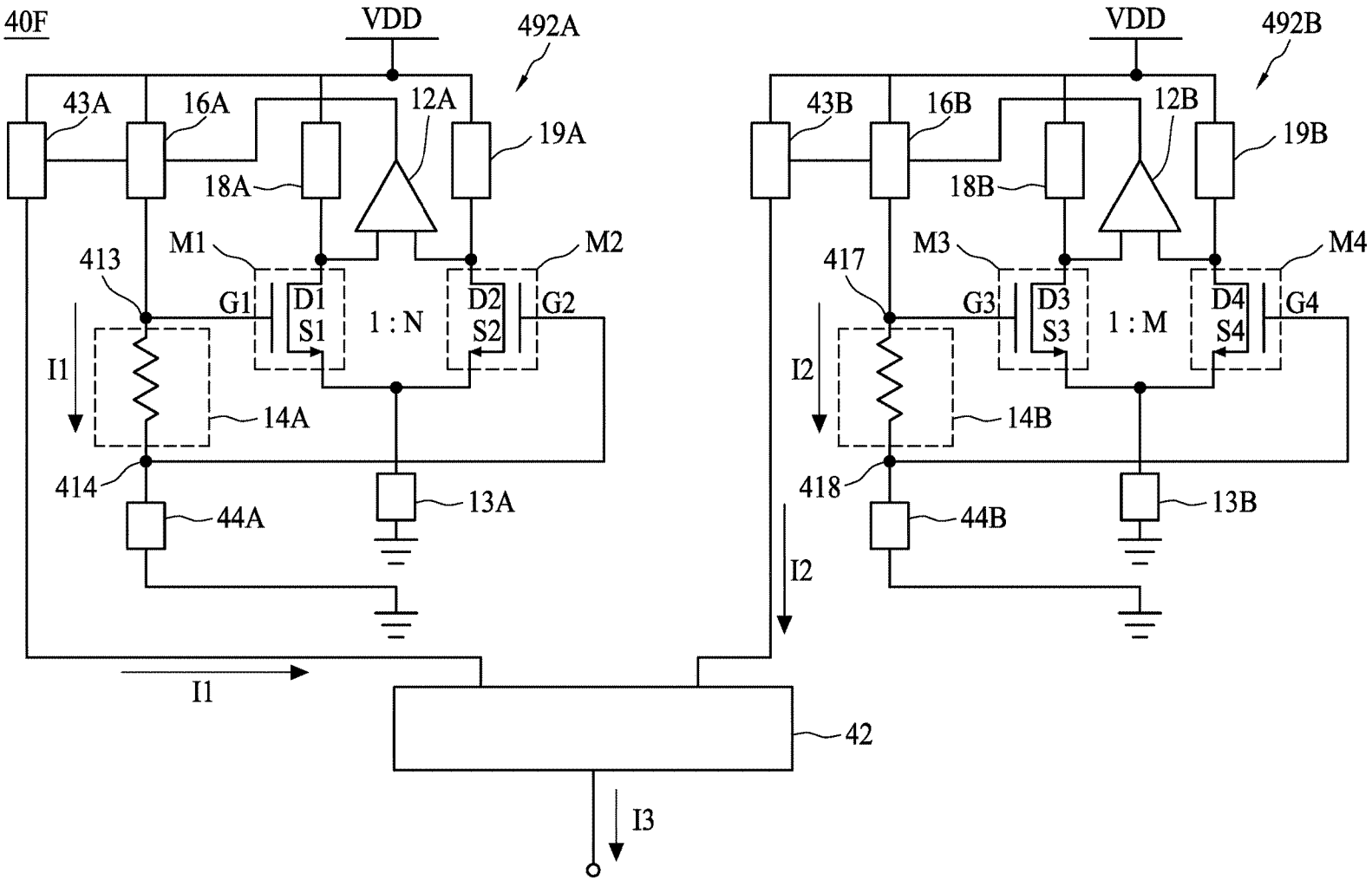
FIG. 4F is a diagram of a circuit capable of generating a current irrespective of temperature variation, in accordance with some embodiments.

FIG. 4F is a diagram of a circuit 40F capable of generating a current I3 irrespective of temperature variation, in accordance with some embodiments. Referring to FIG. 4F, the circuit 40F is similar to the circuit 40E described and illustrated with reference to FIG. 4E except that, for example, the circuit 40F includes a first PTAT generating circuit 492A including a first tail current source 13A and a second PTAT generating circuit 492B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 4G:
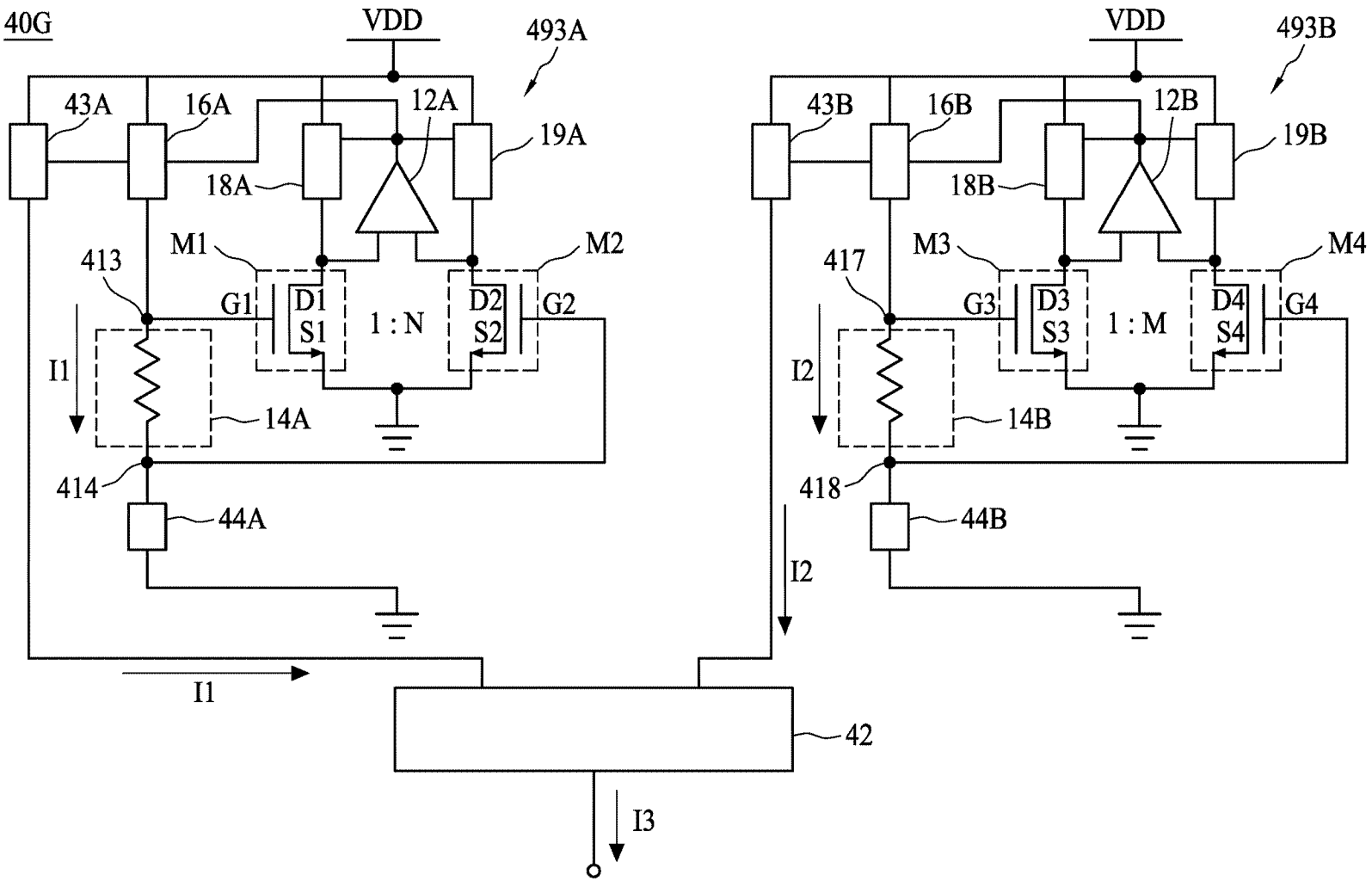
FIG. 4G is a diagram of a circuit capable of generating a current irrespective of temperature variation, in accordance with some embodiments.

FIG. 4G is a diagram of a circuit 40G capable of generating a current I3 irrespective of temperature variation, in accordance with some embodiments. Referring to FIG. 4G, the circuit 40G is similar to the circuit 40E described and illustrated with reference to FIG. 4E except that electrical connection between the amplifier 12A, first current source 18A and second current source 19A of a first PTAT generating circuit 493A and between the amplifier 12B, third current source 18B and fourth current source 19B of a second PTAT generating circuit 493B is respectively different from that between similar components of the first PTAT generating circuit 491A and the second PTAT generating circuit 491B described and illustrated with reference to FIG. 4E. Specifically, an output of the amplifier 12A is coupled to the electrical component 16A, the first current source 18A and the second current source 19A, and functions to control the electrical component 16A, the first current source 18A and the second current source 19A. Similarly, an output of the amplifier 12B is coupled to the electrical component 16B, the first current source 18A and the second current source 19A, and functions to control the electrical component 16B, the first current source 18B and the second current source 19B.

Figure 4H:
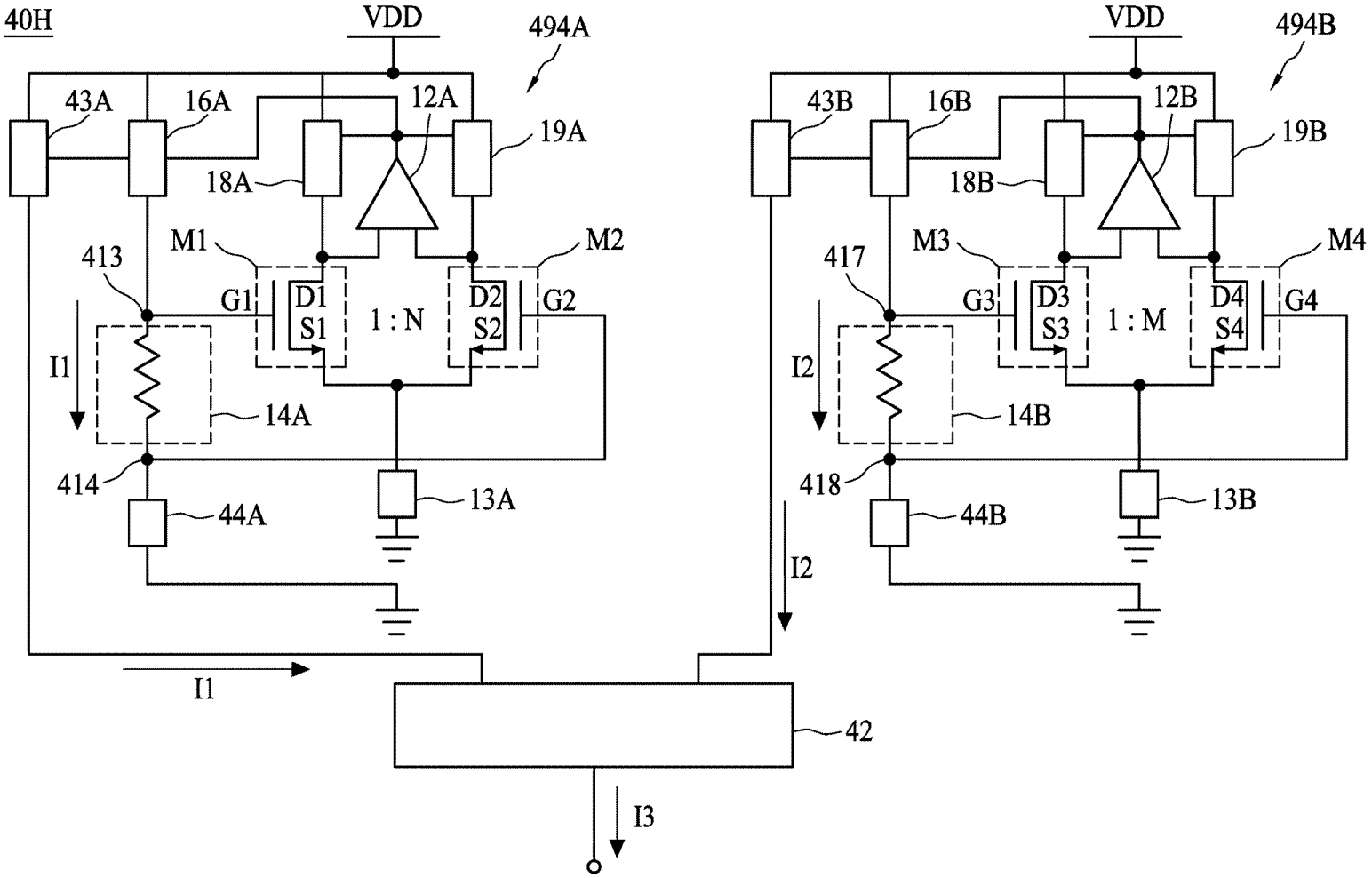
FIG. 4H is a diagram of a circuit capable of generating a current irrespective of temperature variation, in accordance with some embodiments.

FIG. 4H is a diagram of a circuit 40H capable of generating a current I3 irrespective of temperature variation, in accordance with some embodiments. Referring to FIG. 4H, the circuit 40H is similar to the circuit 40G described and illustrated with reference to FIG. 4G except that, for example, the circuit 40H includes a first PTAT generating circuit 494A including a first tail current source 13A and a second PTAT generating circuit 494B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 5:
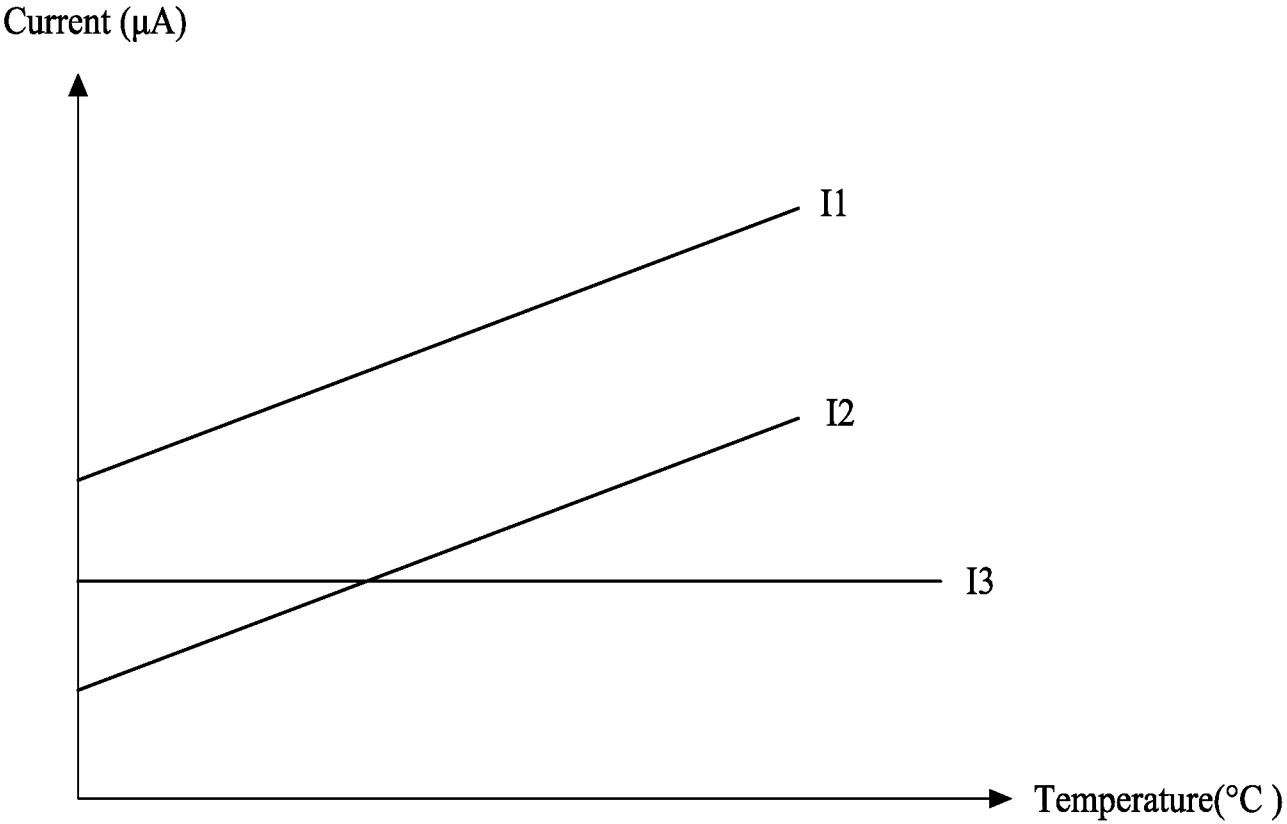
FIG. 5 is a schematic diagram showing a resultant current provided by the circuit illustrated in FIG. 4A.

FIG. 5 is a schematic diagram showing the resultant current I3 provided by the circuit 40A illustrated in FIG. 4A. Referring to FIG. 5, the first PTAT current I1 and the second PTAT current I2 are temperature-dependent currents. Nevertheless, as previously discussed with reference to FIG. 2, since current variation is relatively small, by subtracting the first PTAT current I1 from the second PTAT current I2 or vice versa, the temperature-dependent factor is counter canceled or significantly suppressed. Therefore, the current I3 is irrespective of temperature variation, and behaves as a constant current.

Figure 6A:
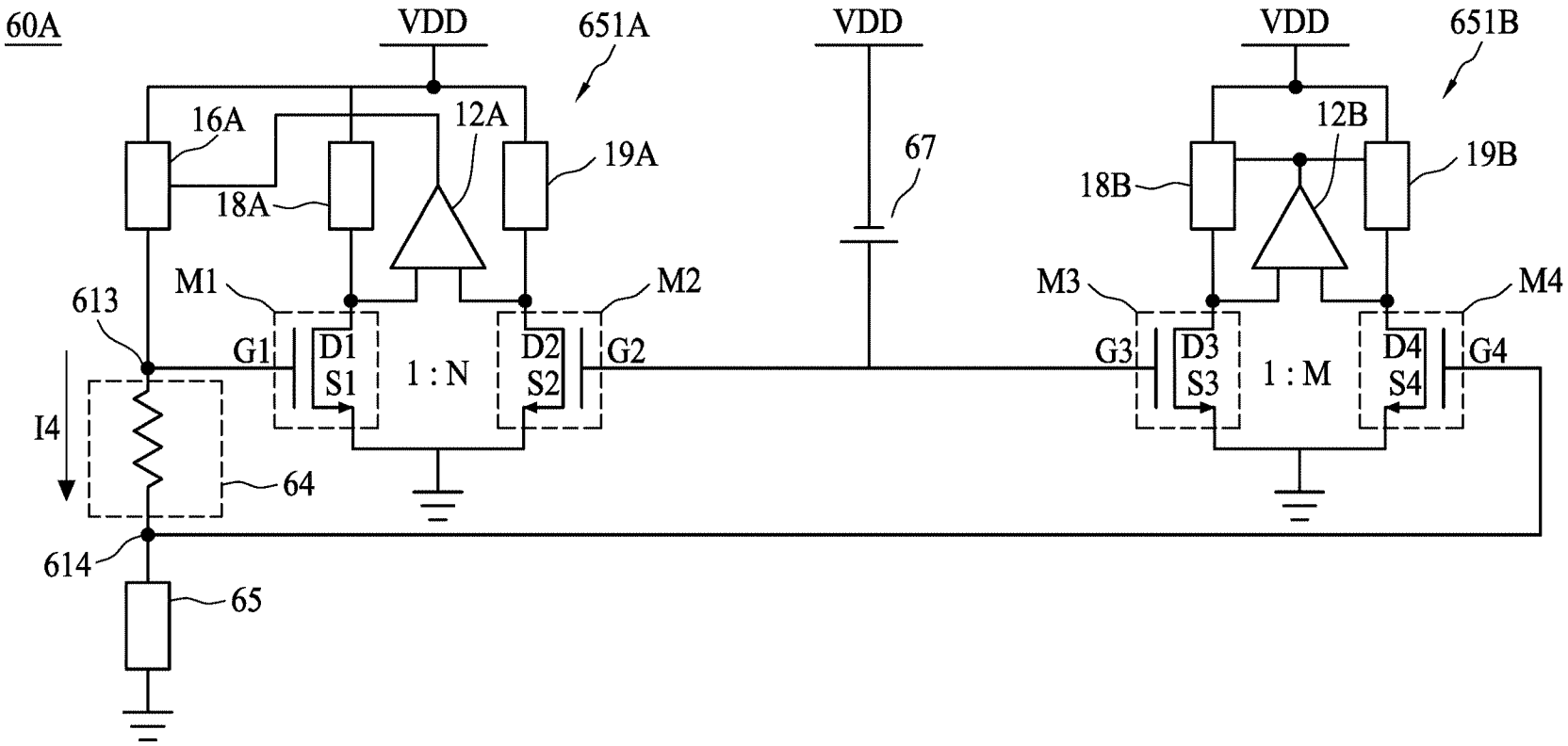
FIG. 6A is a diagram of a circuit capable of generating a current irrespective of temperature variation, in accordance with some embodiments.

FIG. 6A is a diagram of a circuit 60A capable of generating a current I4 irrespective of temperature variation, in accordance with some embodiments. Referring to FIG. 6A, the circuit 60A is similar to the circuit 40A described and illustrated with reference to FIG. 4A and includes a first PTAT generating circuit 651A, a second PTAT generating circuit 651B and a resistive device 64.

The first PTAT generating circuit 651A, similar to the first PTAT generating circuit 45A described and illustrated with reference to FIG. 4A, includes an amplifier 12A, a first current source 18A, a second current source 19A, a first transistor M1 and a second transistor M2.

The first transistor M1 includes a first drain D1, a first gate G1, and a first source S1. The first drain D1 is coupled to the first input of the amplifier 12A, and to the power supply VDD via the first current source 18A. The first gate G1 is coupled to one end 613 of the resistive device 64, and to the power supply VDD via an electronic component 16A. The first source S1 is coupled to the reference GND.

The second transistor M2 includes a second drain D2, a second gate G2, and a second source S2. The second drain D2 is coupled to the second input of the amplifier 12A, and to the power supply VDD via the second current source 19A. The second gate G2 is coupled to the power supply VDD via a bias voltage 67. Moreover, the second source S2 is coupled to the reference GND, and to the first source S1 of the first transistor M1.

The second PTAT generating circuit 651B, similar to the second PTAT generating circuit 45B described and illustrated with reference to FIG. 4A, includes an amplifier 12B, a third current source 18B, a fourth current source 19B, a third transistor M3 and a fourth transistor M4.

The third transistor M3 includes a third drain D3, a third gate G3, and a third source S3. The third drain D3 is coupled to the first input of the amplifier 12B, and to the power supply VDD via the third current source 18B. The third gate G3 is coupled to the second gate G2 of the second transistor M2, and to the power supply VDD via the bias voltage 67. The third source S3 is coupled to the reference GND. The bias voltage 67 functions to bias the second transistor M2 and the third transistor M3.

The fourth transistor M4 includes a fourth drain D4, a fourth gate G4, and a fourth source S4. The fourth drain D4 is coupled to the second input of the amplifier 12B, and to the power supply VDD via the fourth current source 19B. The fourth gate G4 is coupled to the other end 614 of the resistive device 64, and to an electronic component 65. Moreover, the fourth source S4 is coupled to the reference GND, and to the third source S3 of the third transistor M3.

The current I4 irrespective of temperature variation can be expressed in equation (13) as follows:

$$I4 = \frac{(VGS1 - VGS2) - (VGS3 - VGS4)}{R} \tag{13}$$

Where R represents a resistance of the resistive device 64.

Based on equation (13), the current I4 irrespective of temperature variation is determined by a first gate to source voltage VGS1, a second gate to source voltage VGS2, a third gate to source voltage VGS3 and a fourth gate to source voltage VGS4.

Slope of the currents I1 and I2 (referring to FIG. 5) may be adjusted by adjusting the resistance of the resistive device 14A and the resistive device 14B. Accordingly, if the current I1 and the current I2 have substantially the same slope within a temperature range, the resistance of the resistive device 14A is equal to the resistance of resistive device 14B. By comparison, the first row of equation (9) is the same as equation (13) when, in equation (9), the resistance of the resistive device 14A is equal to the resistance of the resistive device 14B. Therefore, as previously discussed with reference to equation (9), the current I4 is a constant current, which is determined by a difference between threshold voltages and can be well controlled by process.

Moreover, as previously discussed in the embodiments illustrated in FIG. 1A, since a first drain D1 of a first transistor M1 and a second drain D2 of a second transistor M2 are respectively coupled to a first input and a second input of the amplifier 12A, the voltage level at the first drain D1 and the voltage level at the second drain D2 are kept equal to each other by the amplifier 12A.

Similarly, since a third drain D3 of a third transistor M3 and a fourth drain D4 of a fourth transistor M4 are respectively coupled to a first input and a second input of the amplifier 12B, the voltage level at the third drain D3 and the voltage level at the fourth drain D4 are kept equal to each other by the amplifier 12B.

With the amplifiers 12A and 12B, variation in the current I4 resulting from the voltage difference between the first drain D1 and the second drain D2, and from the voltage difference between the third drain D3 and the fourth drain D4 is alleviated or even eliminated.

Figure 6B:
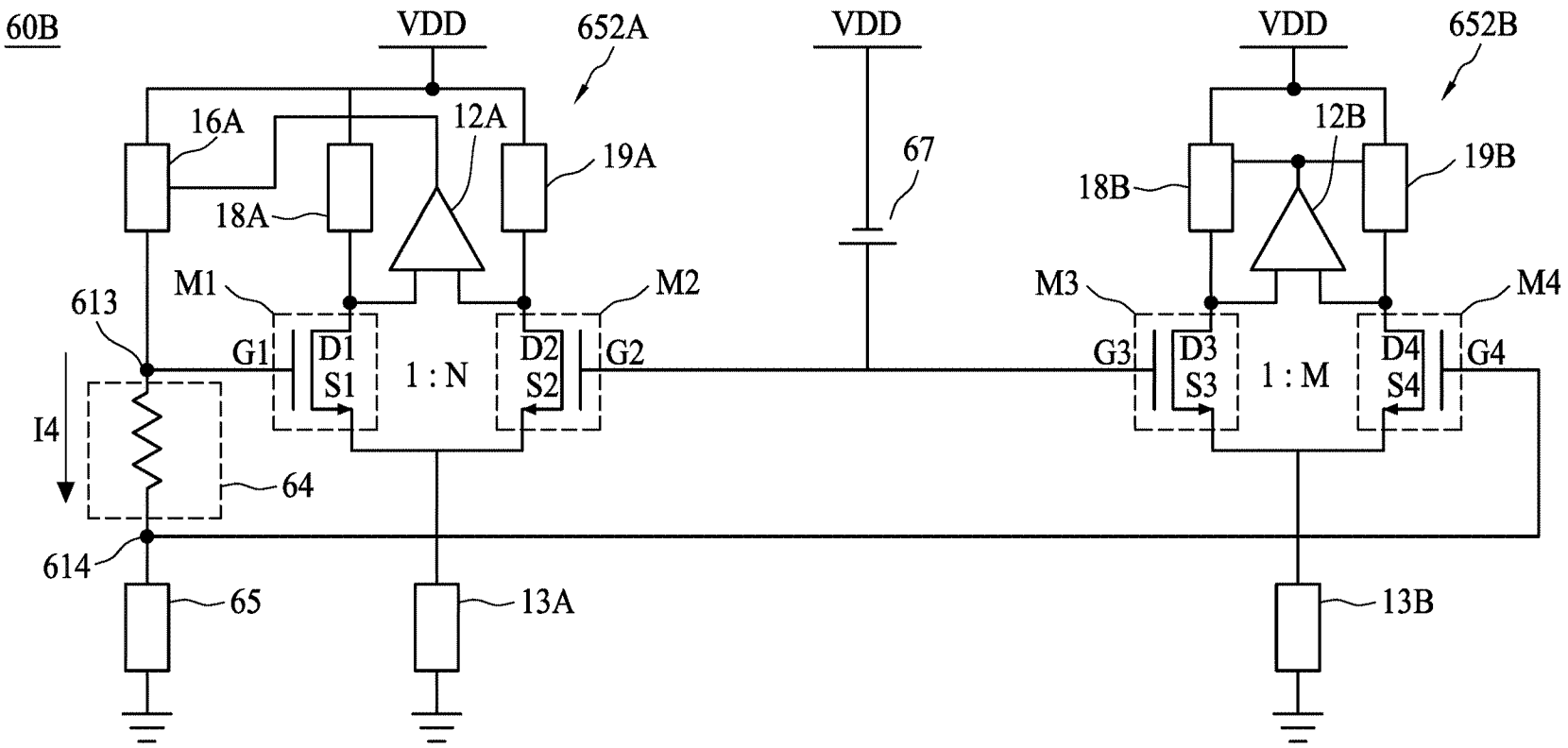
FIG. 6B is a diagram of a circuit capable of generating a current irrespective of temperature variation, in accordance with some embodiments.

FIG. 6B is a diagram of a circuit 60B capable of generating a current I4 irrespective of temperature variation, in accordance with some embodiments. Referring to FIG. 6B, the circuit 60B is similar to the circuit 60A described and illustrated with reference to FIG. 6A except that, for example, the circuit 60B includes a first PTAT generating circuit 652A including a first tail current source 13A and a second PTAT generating circuit 652B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 6C:
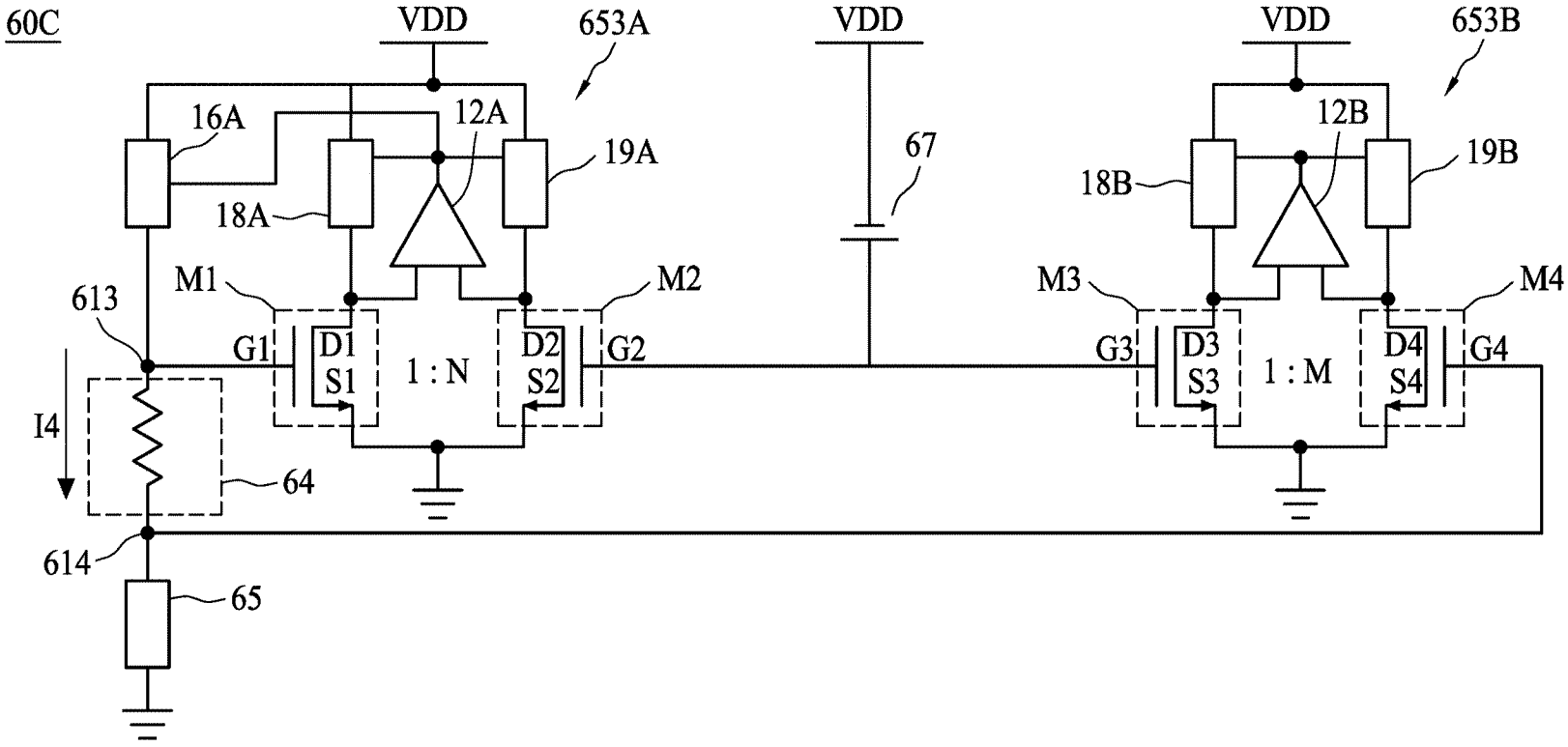
FIG. 6C is a diagram of a circuit capable of generating a current irrespective of temperature variation, in accordance with some embodiments.

FIG. 6C is a diagram of a circuit 60C capable of generating a current I4 irrespective of temperature variation, in accordance with some embodiments. Referring to FIG. 6C, the circuit 60C is similar to the circuit 60A described and illustrated with reference to FIG. 4E except that electrical connection the amplifier 12A, first current source 18A and second current source 19A of a first PTAT generating circuit 653A is different from that between similar components of the first PTAT generating circuit 651A described and illustrated with reference to FIG. 4F. Specifically, an output of the amplifier 12A is coupled to the electrical component 16A, the first current source 18A and the second current source 19A, and functions to control the electrical component 16A, the first current source 18A and the second current source 19A.

Figure 6D:
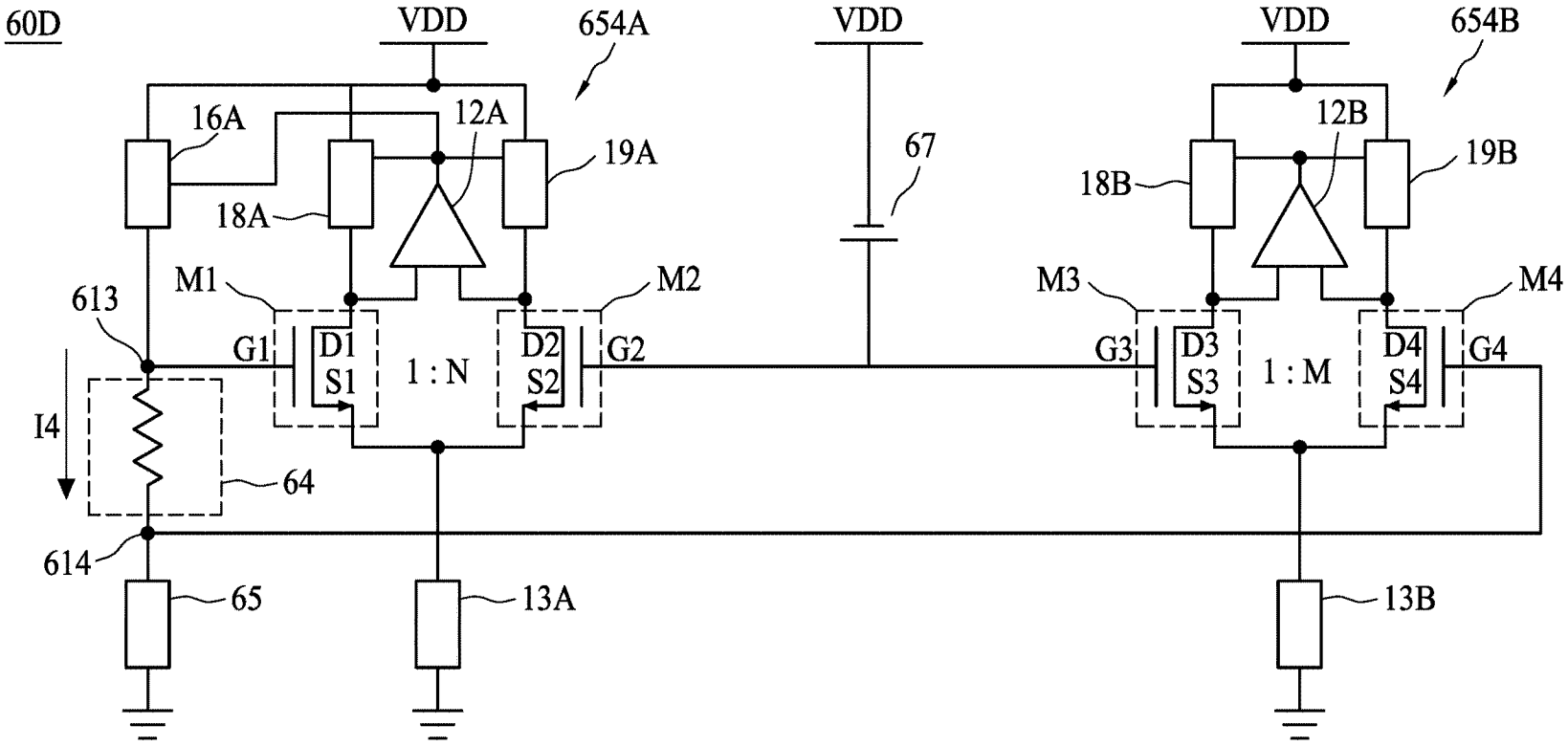
FIG. 6D is a diagram of a circuit capable of generating a current irrespective of temperature variation, in accordance with some embodiments.

FIG. 6D is a diagram of a circuit 60D capable of generating a current I4 irrespective of temperature variation, in accordance with some embodiments. Referring to FIG. 6D, the circuit 60D is similar to the circuit 60C described and illustrated with reference to FIG. 6C except that, for example, the circuit 60D includes a first PTAT generating circuit 654A including a first tail current source 13A and a second PTAT generating circuit 654B including a second tail current source 13B. The first tail current source 13A is coupled between the first source S1 of the first transistor M1 (or the second source S2 of the second transistor M2) and the reference GND. The second tail current source 13B is coupled between the third source S3 of the third transistor M3 (or the fourth source S4 of the fourth transistor M4) and the reference GND. The first tail current 13A functions to provide current to the first transistor M1 and the second transistor M2. The second tail current 13B functions to provide current to the third transistor M3 and the fourth transistor M4.

Figure 7:
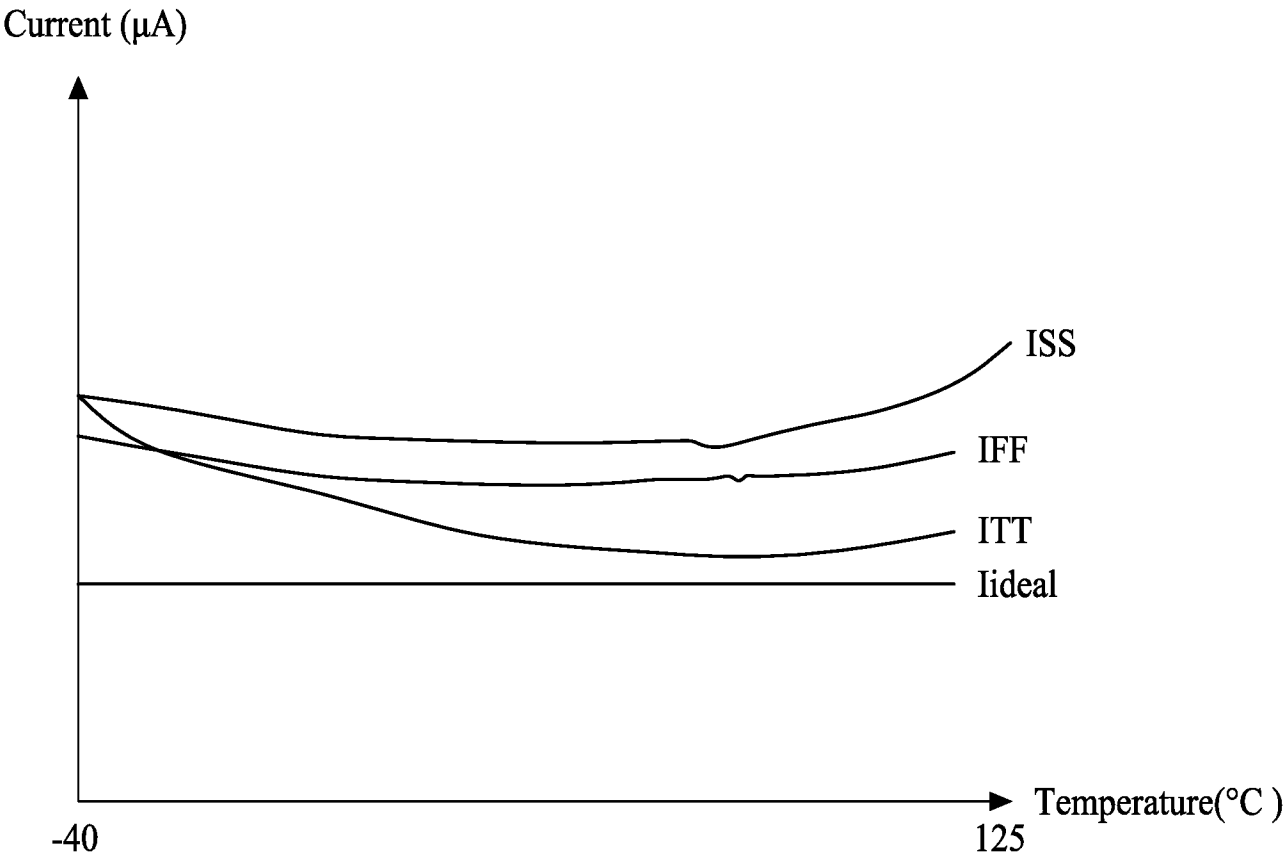
FIG. 7 is a schematic diagram showing simulation results of the circuit illustrated in FIG. 6A at different process corners.

FIG. 7 is a schematic diagram showing simulation results of the circuit 60A illustrated in FIG. 6A at different process corners. Specifically, a simulation for the circuit 60A is conducted at corners FF (fast to fast), SS (slow to slow) and TT (typical to typical) and given the power supply VDD of 0.5 Volts (V). Referring to FIG. 7, curves, ISS, IFF and ITT, which respectively represent currents at the corners FF, SS and TT, are close to the Iideal curve that represents the ideal current. The simulation results reveal that the current I4 generated by the circuit 60A is a substantially constant current. In an embodiment, simulation is conducted over a temperature range from −40° C. to 125° C., with the temperature coefficient at 25° C. being approximately 70 PPM/° C. In another embodiment, simulation is conducted over a temperature range from −20° C. to 125° C., with the temperature coefficient at 25° C. being approximately 50 PPM/° C. According to results of the simulations, the current variation in the current I4 at corners FF, SS and TT is approximately ±1.6%.

Some embodiments have one or a combination of the following features and/or advantages. In some embodiments, a circuit includes a first transistor, a second transistor, a resistive device and an amplifier. The first transistor includes a first drain and a first gate. The second transistor includes a second drain and a second gate. The resistive device is coupled between the first gate and the second gate. The amplifier includes a first input coupled to the first drain and a second input coupled to the second drain. The amplifier is configured to keep a voltage level at the first drain and that at the second drain equal to each other.

In some embodiments, a circuit is provided. The circuit includes a first current generating circuit to provide a first current, a second current generating circuit to provide a second current, and a current subtracter. The first current generating circuit includes a first pair of transistors, a first resistive device and a first amplifier. The first pair of transistors includes a first transistor including a first drain and a first gate, and a second transistor including a second drain and a second gate. The first resistive device is coupled between the first gate and the second gate. The first amplifier includes a first input coupled to the first drain and a second input coupled to the second drain. The first amplifier is configured to keep a voltage level at the first drain and that at the second drain equal to each other. The second current generating circuit includes a second pair of transistors, a second resistive device, and a second amplifier. The second pair of transistors includes a third transistor including a third drain and a third gate, and a fourth transistor including a fourth drain and a fourth gate. The second resistive device is coupled between the third gate and the fourth gate. The second amplifier includes a first input coupled to the third drain and a second input coupled to the fourth drain. The second amplifier is configured to keep a voltage level at the third drain and that at the fourth drain equal to each other. The current subtracter is configured to receive the first current and the second current, and generate a third current by either subtracting the first current from the second current, or subtracting the second current from the first current.

In some embodiments, a circuit is provided. The circuit includes a first current generating circuit, a second current generating circuit and a resistive device. The first current generating circuit includes a first pair of transistors and a first amplifier. The first pair of transistors includes a first transistor including a first drain and a first gate, and a second transistor including a second drain and a second gate. The first amplifier includes a first input coupled to the first drain and a second input coupled to the second drain. The first amplifier is configured to keep a voltage level at the first drain and that at the second drain equal to each other. The second current generating circuit includes a second pair of transistors and a second amplifier. The second pair of transistors includes a third transistor including a third drain and a third gate, and a fourth transistor including a fourth drain and a fourth gate. The second amplifier includes a first input coupled to the third drain and a second input coupled to the fourth drain. The second amplifier is configured to keep a voltage level at the third drain and that at the fourth drain equal to each other. The resistive device is coupled between the first gate and the fourth gate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A circuit, comprising:

a first transistor including a first drain and a first gate;

a second transistor including a second drain and a second gate;

a resistive device, coupled between the first gate and the second gate; and an amplifier including a first input coupled to the first drain and a second input coupled to the second drain, the amplifier configured to keep a voltage level at the first drain and that at the second drain equal to each other, wherein a current flowing through the resistive device can be expressed as:

$$I=(VGS1-VGS2)/R$$

Where I represents the current; VGS1 represents a first gate to source voltage of the first transistor; VGS2 represents a second gate to source voltage of the second transistor; and R represents resistance of the resistive device.

2. The circuit as claimed in claim 1, wherein:

the first transistor has a first threshold voltage; and the second transistor has a second threshold voltage equal to the first threshold voltage.

3. The circuit as claimed in claim 1, wherein:

the first transistor has a first threshold voltage; and the second transistor has a second threshold voltage different from the second threshold voltage.

4. The circuit as claimed in claim 1 further comprising:

a first current source providing a current flowing through the first drain; and a second current source providing a current flowing through the second drain, the first current source and the second current source forming a current mirror.

5. A circuit, comprising:

a first current generating circuit to provide a first current, comprising:

a first pair of transistors, comprising:

a first transistor including a first drain and a first gate; and a second transistor including a second drain and a second gate;

a first resistive device, coupled between the first gate and the second gate; and a first amplifier including a first input coupled to the first drain and a second input coupled to the second drain, the first amplifier configured to keep a voltage level at the first drain and that at the second drain equal to each other;

a second current generating circuit to provide a second current, comprising:

a second pair of transistors, comprising:

a third transistor including a third drain and a third gate; and a fourth transistor including a fourth drain and a fourth gate; and a second resistive device, coupled between the third gate and the fourth gate; and a second amplifier including a first input coupled to the third drain and a second input coupled to the fourth drain, the second amplifier configured to keep a voltage level at the third drain and that at the fourth drain equal to each other; and a current subtracter, configured to receive the first current and the second current, and generate a third current by either subtracting the first current from the second current, or subtracting the second current from the first current.

6. The circuit as claimed in claim 5, wherein:

the first transistor has a first threshold voltage;

the second transistor has a second threshold voltage;

the third transistor has a third threshold voltage; and the fourth transistor has a fourth threshold voltage, wherein at least one of the first threshold voltage, the second threshold voltage, the third threshold voltage and the fourth threshold voltage is different from the remaining.

7. The circuit as claimed in claim 6, wherein the first threshold voltage is different from the second threshold voltage, and the third threshold voltage is different from the fourth threshold voltage.

8. The circuit as claimed in claim 6, wherein:

the first transistor has a first size;

the second transistor has a second size;

the third transistor has a third size;

the fourth transistor has a fourth size;

the first resistive device has a first resistance;

the second resistive device has a second resistance equal to the first resistance;

a ratio of the first size to the second size is defined as a first size ratio;

a ratio of the third size to the fourth size is defined as a second size ratio equal to the first size ratio; and one of the following:

the second threshold voltage is equal to the fourth threshold voltage, the second threshold voltage is different from the first threshold voltage, and the fourth threshold voltage is different from the third threshold voltage; and the first threshold voltage is equal to the third threshold voltage, the first threshold voltage is different from the second threshold voltage, and the third threshold voltage is different from the fourth threshold voltage.

9. The circuit as claimed in claim 8, wherein the third current is expressed as follows:

$$I(\Delta Vt'-\Delta Vt'')$$

where I represents the third current, ΔVt' represents a difference between the first threshold voltage and the second threshold voltage, and ΔVt" represents a difference between the third threshold voltage and the fourth threshold voltage.

10. The circuit as claimed in claim 8, wherein:

the first transistor has a first size;

the second transistor has a second size;

the third transistor has a third size;

the fourth transistor has a fourth size;

the first resistive device has a first resistance the second resistive device has a second resistance;

a ratio of the first size to the second size is defined as a first size ratio;

a ratio of the third size to the fourth size is defined as a second size ratio, wherein relation between the first size ratio, the second size ratio, the first resistance and the second resistance is expressed as follows:

$$\frac{Vtx\ln N}{R1} = \frac{Vtz\ln M}{R2}$$

Where N represents the first size ratio, M represents the second size ratio, R1 represents the first resistance, R2 represents the second resistance, Vtx represents one of the first threshold voltage and the second threshold voltage, and Vtz represents one of the third threshold voltage and the fourth threshold voltage.

11. The circuit as claimed in claim 6, wherein the first transistor has a first size;

the second transistor has a second size;

the third transistor has a third size;

the fourth transistor has a fourth size;

the first resistive device has a first resistance;

the second resistive device has a second resistance equal to the first resistance;

a ratio of the first size to the second size is defined as a first size ratio;

a ratio of the third size to the fourth size is defined as a second size ratio equal to the first size ratio; and one of the following:

the second threshold voltage is equal to the fourth threshold voltage, the second threshold voltage is different from the first threshold voltage, and the fourth threshold voltage is equal to the third threshold voltage; and the first threshold voltage is equal to the third threshold voltage, the first threshold voltage is different from the second threshold voltage, and the third threshold voltage is equal to the fourth threshold voltage.

12. The circuit as claimed in claim 11, wherein the third current is expressed as follows:

$$I=\Delta Vt'$$

where I represents the third current, and ΔVt' represents a difference between the first threshold voltage and the second threshold voltage.

13. The circuit as claimed in claim 5, wherein the first current and the second current are a proportional to absolute temperature (PTAT) current.

14. A circuit, comprising:

a first current generating circuit to provide a first current, comprising:

a first pair of transistors, comprising:

a first transistor including a first drain and a first gate; and a second transistor including a second drain and a second gate;

a first resistive device, directly coupled between the first gate and the second gate; and a first amplifier including a first input coupled to the first drain and a second input coupled to the second drain, the first amplifier configured to keep a voltage level at the first drain and that at the second drain equal to each other;

a second current generating circuit to provide a second current, comprising:

a second pair of transistors, comprising:

a third transistor including a third drain and a third gate; and a fourth transistor including a fourth drain and a fourth gate; and a second resistive device, directly coupled between the third gate and the fourth gate; and a second amplifier including a first input coupled to the third drain and a second input coupled to the fourth drain, the second amplifier configured to keep a voltage level at the third drain and that at the fourth drain equal to each other; and a current subtracter, configured to receive the first current and the second current, and generate a third current by either subtracting the first current from the second current, or subtracting the second current from the first current.

15. The circuit as claimed in claim 14, wherein:

the first transistor has a first threshold voltage;

the second transistor has a second threshold voltage;

the third transistor has a third threshold voltage; and the fourth transistor has a fourth threshold voltage, wherein at least one of the first threshold voltage, the second threshold voltage, the third threshold voltage and the fourth threshold voltage is different from the remaining.

16. The circuit as claimed in claim 15, wherein the first threshold voltage is different from the second threshold voltage, and the third threshold voltage is different from the fourth threshold voltage.

17. The circuit as claimed in claim 15, wherein:

the first transistor has a first size;

the second transistor has a second size;

the third transistor has a third size;

the fourth transistor has a fourth size;

the first resistive device has a first resistance;

the second resistive device has a second resistance equal to the first resistance;

a ratio of the first size to the second size is defined as a first size ratio;

a ratio of the third size to the fourth size is defined as a second size ratio equal to the first size ratio; and one of the following:

the second threshold voltage is equal to the fourth threshold voltage, the second threshold voltage is different from the first threshold voltage, and the fourth threshold voltage is different from the third threshold voltage; and the first threshold voltage is equal to the third threshold voltage, the first threshold voltage is different from the second threshold voltage, and the third threshold voltage is different from the fourth threshold voltage.

18. The circuit as claimed in claim 17, wherein the third current is expressed as follows:

$$I=(\Delta Vt'-\Delta Vt'')$$

where I represents the third current, ΔVt' represents a difference between the first threshold voltage and the second threshold voltage, and ΔVt" represents a difference between the third threshold voltage and the fourth threshold voltage.

19. The circuit as claimed in claim 15, wherein the first transistor has a first size;

the second transistor has a second size;

the third transistor has a third size;

the fourth transistor has a fourth size;

the first resistive device has a first resistance;

the second resistive device has a second resistance equal to the first resistance;

a ratio of the first size to the second size is defined as a first size ratio;

a ratio of the third size to the fourth size is defined as a second size ratio equal to the first size ratio; and one of the following:

the second threshold voltage is equal to the fourth threshold voltage, the second threshold voltage is different from the first threshold voltage, and the fourth threshold voltage is equal to the third threshold voltage; and the first threshold voltage is equal to the third threshold voltage, the first threshold voltage is different from the second threshold voltage, and the third threshold voltage is equal to the fourth threshold voltage.

20. The circuit as claimed in claim 19, wherein the third current is expressed as follows:

$$I=\Delta Vt'$$

where I represents the third current, and ΔVt' represents a difference between the first threshold voltage and the second threshold voltage.

* * * * *